United States Patent [19]

Imamura et al.

[11] 4,424,732

[45] Jan. 10, 1984

[54] ELECTRONIC MUSICAL INSTRUMENT WITH INTERMANUAL PERFORMANCE FACULTY

[75] Inventors: Akio Imamura, Hamamatsu; Yasuji Uchiyama, Hamakita; Akira Nakada, Hamamatsu, all of Japan

[73] Assignee: Nippon Gakki Seizo Kabushiki Kaisha, Tokyo, Japan

[21] Appl. No.: 376,544

[22] Filed: May 10, 1982

Related U.S. Application Data

[63] Continuation of Ser. No. 114,733, Jan. 24, 1980, abandoned.

[30] Foreign Application Priority Data

Jan. 29, 1979 [JP] Japan ..... 54-8870
Jan. 29, 1979 [JP] Japan ..... 54-8871

[51] Int. Cl.[3] ..... G10H 1/22
[52] U.S. Cl. ..... 84/1.17; 84/DIG. 2
[58] Field of Search ..... 84/1.01, 1.03, 1.17, 84/1.24, DIG. 2

[56] References Cited

U.S. PATENT DOCUMENTS

| | | | |
|---|---|---|---|
| 3,999,458 | 12/1976 | Suzuki | 84/1.01 |
| 4,100,831 | 7/1978 | Deutsch | 84/1.01 |
| 4,148,017 | 4/1979 | Tomisawa | 84/1.01 X |
| 4,178,824 | 12/1979 | Aoki et al. | 84/DIG. 2 |
| 4,184,401 | 1/1980 | Hiyoshi et al. | 84/1.01 X |
| 4,192,211 | 3/1980 | Yamaga et al. | 84/1.01 |

*Primary Examiner*—Stanley J. Witkowski
*Attorney, Agent, or Firm*—Thompson, Birch, Gaunthier & Samuels

[57] ABSTRACT

An electronic musical instrument includes an upper, lower and pedal key boards and a solo keyboard, key switches and associated circuits for producing key codes of the depressed keys, and musical tone signal generators which generate musical tone signals in accordnace with the key codes. A priority selection circuit is provided for selecting a single key code from among a plurality of concurrent key codes with respect to plural keyboards in accordance with a predetermined order of priority, and a musical signal is generated by a predetermined generating system for producing a musical tone signal generator in accordance with the selected key code. Thus, a special intermanual coupler effect is realized.

8 Claims, 13 Drawing Figures

ELECTRONIC MUSICAL INSTRUMENT WITH INTERMANUAL PERFORMANCE FACULTY

This application is a continuation of application Ser. No. 114,733, filed Jan. 24, 1980 and now abandoned.

BACKGROUND OF THE INVENTION

This invention relates to an electronic musical instrument, more particularly an electronic musical instrument provided with a plurality of keyboards each having a plurality of keys, and an intermanual performance arrangement.

A so called 4-keyboard type electronic musical instrument has been known which in addition to a main musical tone generating system constituted by a main keyboard section comprising an upper keyboard, a low keyboard and a pedal keyboard, and a main musical tone signal generating section which generates musical tone signals associated with the tone pitches of the depressed keys in the main keyboard section, includes a solo keyboard section for performing a solo, and a solo musical tone signal generator which generates musical tone signals related to the tone pitches of the depressed keys in the solo keyboard section. In an electronic organ of this type, it is possible to preset the solo musical tone signal generating section to be of a suitable tone color for performing a solo independently of the main musical tone signal generating system by independently constructing the solo musical tone generating system including the solo keyboard and the solo musical signal generator from the main musical tone generating system thereby enabling transfer between the main performance and the solo performance during the performance as well as an ensemble of the main and solo performances.

According to one method of intermanual coupling, the solo performance can be made by using the upper keyboard or the lower keyboard (or the pedal keyboard). Such intermanual coupler can be realized by supplying the key information of the upper or lower keyboard (or pedal keyboard) to the solo musical tone signal generating system instead of the key information of the depressed keys of the solo keyboard section. Supply of the key information of one of the keyboards can be suitably selected by a coupler keyboard selection switch. For example, when the coupler keyboard selection switch is thrown to the solo keyboard, it is possible to perform a solo melody on the solo keyboard, and a back chorus on the upper or lower keyboard. Thus, an ensemble of solo performance on the solo keyboard and a back chorus performance on the upper or lower keyboard. Where the coupler keyboard selection switch is set to the upper keyboard, a melody performance on the upper keyboard with an accompaniment performance on the lower keyboard will result in prominence of the melody as a solo performance tone to improve the sound effect. Further, when the coupler keyboard selection switch is set to the lower keyboard, it is possible to enhance the chord performance on the lower keyboard with a counter melody in the solo tone. Where the coupler keyboard selection switch is set to the pedal keyboard, it is possible to enhance the bass tone performance on the pedal keyboard with a solo performance (a solo bass or a walking bass) to improve the sound effect. Especially in the last mentioned case, the solo bass performance can be treated as a melody to emphasize the bass tones.

The intermanual coupler of the electronic musical instrument described above, however, was merely used to supply the key information of the keyboard selected by the coupler keyboard selection switch to the solo musical tone signal generating section so that it is necessary to operate the coupler keyboard selection switch at each time in order to change the condition of the intermanual coupler (to change the correspondence of the solo musical tone signal generating section to a selected keyboard). Accordingly, it is extremely difficult to change the condition of the intermanual coupler during performance.

SUMMARY OF THE INVENTION

Accordingly, it is the principal object of this invention to provide an electronic musical instrument having an intermanual coupler performance faculty that enables ready and automatic change of the coupler condition.

Another object of this invention is to provide an electronic musical instrument giving a priority to a condition of the intermanual coupler for a specific keyboard.

According to this invention there is provided an electronic musical instrument of the type comprising a plurality of keyboards each provided with a plurality of keys, key detectors provided for the respective keyboards for producing key identifying signals corresponding to depressed keys, keyboard-dependent tone production systems provided for respective key detectors for producing musical tone signals in accordance with the respective key identifying signals, characterized in that there are provided priority selection means for selecting a single key identifying signal from among the key identifying signals produced by the key detectors in accordance with a predetermined order of priority, and a musical tone signal generating system for producing a musical tone signal in accordance with the selected key identifying signal.

According to a preferred embodiment, the keyboards comprise upper and lower keyboards (or a pedal keyboard) and a solo keyboard, and constructed such that a key information representing a depressed key of the solo keyboard is compared with key informations of the depressed keys in the upper, lower or pedal keyboard so as to select only a single key information representing the highest or lowest key among all the keys and supply the selected key information to a solo musical tone signal generator so that it is possible to automatically change the intermanual internal coupler condition by merely changing the manner of key depression of the keyboard without operating any coupler switch, thereby greatly improving the performance characteristics of the electronic musical instrument.

DESCRIPTION OF THE PREFERRED EMBODIMENT

Figure 1:
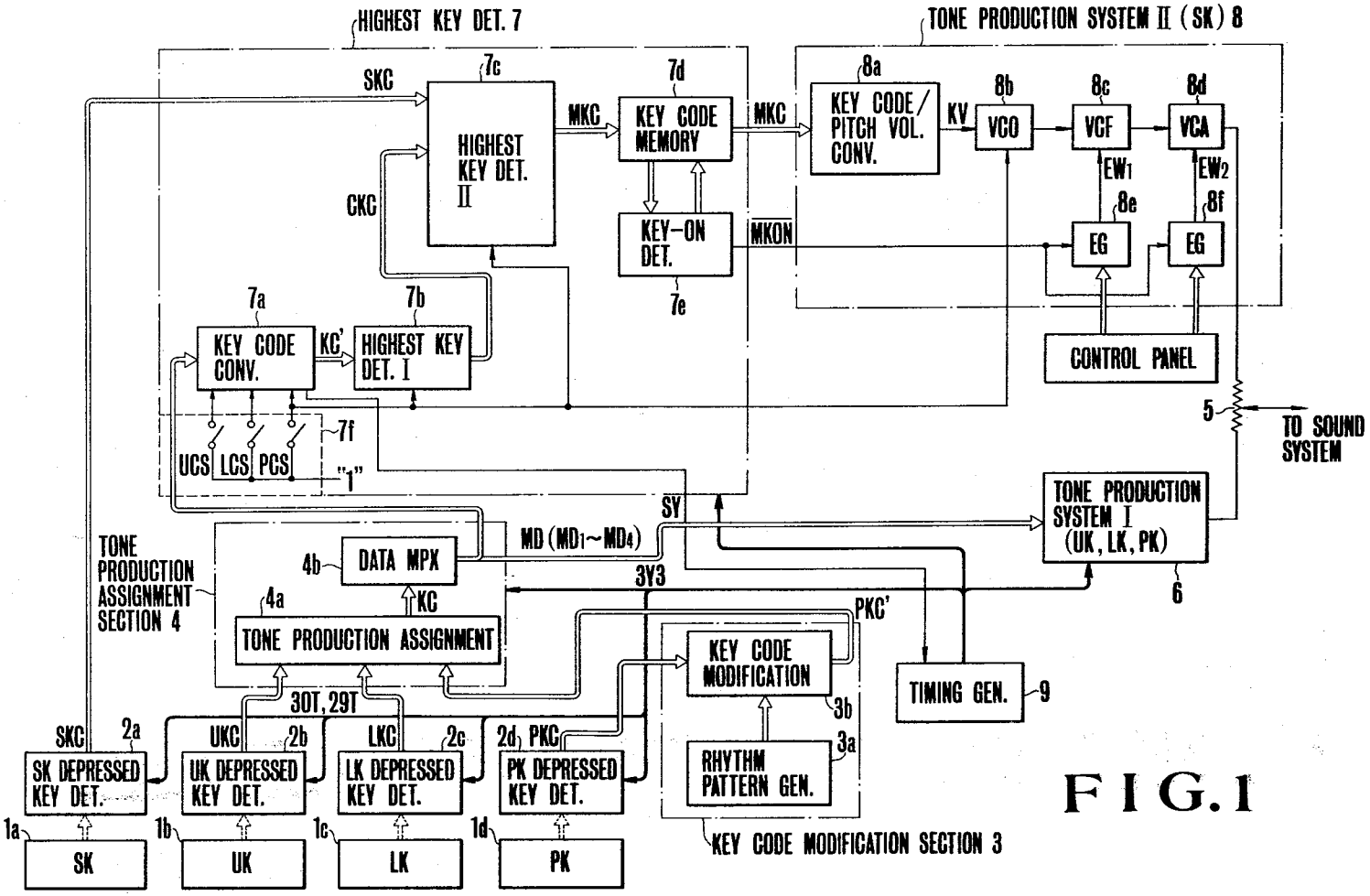
FIG. 1 is a block diagram showing the general construction of one embodiment of the musical instrument according to this invention.

The electronic musical instrument of this invention comprises, as shown in FIG. 1, a solo keyboard (SK) 1*a*; an upper keyboard (UK) 1*b*; a lower keyboard (LK) 1*c*; a pedal keyboard (PK) 1*d*, depressed key detection circuits 2*a* to 2*d* (hereinafter called an SK depressed key detection circuit, a UK depressed key detection circuit, an LK depressed key detection circuit, and a PK depressed key detection circuit respectively), each including key switches corresponding to respective keys of these keyboards for detecting depressed (actuated) key switches (in the case of a make contact, closing operation, whereas in the case of a break contact, an opening operation) to produce encoded key informations (hereinafter called key codes SKC, UKC, LKC and PKC which represent detected key switches); a key code modification section 3; a tone production assignment section which is supplied with the key codes UKC and LKC produced by the UK and LK depressed key detection circuits 2*b* and 2*c* and a key code PKC' produced by the key code modification section 3 for assigning these key codes UKC, LKC and PKC' to any one of a plurality of tone production channels (in this embodiment 18 channels) that can simultaneously produce tones of these key codes; a first tone signal production system 6 supplied with the key codes KC (UKC, LKC, PKC) produced by the tone production assignment section 4 and then assigned and processed by respective tone production channels for generating musical tone signals having tone pitches corresponding to the key codes KC assigned to a specific one of the tone generating channels, the first tone signal production system 6 being used for the upper keyboard, the lower keyboard and the pedal keyboard; a highest key detection section 7 which is supplied with the key code SKC produced by the SK depressed key detection circuit 2*a* and the key code KC produced by the tone production assignment section 4 for producing a key code representing the highest tone pitch among both key codes SKC and KC as the highest tone pitch code MKC; a second tone signal production system 8 for performing a solo which is supplied with the highest note key code MKC produced by the highest key detection section 7 for producing a musical tone signal having a tone pitch corresponding to the inputted key code MKC; a mixing resistor 5 for mixing together the musical tone signals generated by the first and second tone signal production systems 6 and 8 to apply the mixed signals to a sound system, not shown, and a timing signal generator 9 which supplies various timing signals to the depressed key detection circuits 2*a* to 2*d*, the tone production assignment section 4, the first and second tone signal production systems 6 and 8, and the highest key detection section 7.

The solo keyboard 1*a*, the upper keyboard 1*b*, the lower keyboard 1*c* and the pedal keyboard 1*d* have key ranges, respectively constituted by corresponding keys shown in the following Table 1.

TABLE 1

| keyboard | number of keys | key range |
|---|---|---|
| solo keyboard | 37 | C4 to C7 |
| upper keyboard | 61 | C2 to C7 |
| lower keyboard | 61 | C2 to C7 |
| pedal keyboard | 25 | C2 to C4 |

The SK depressed key detection circuit 2*a* and the PK depressed key detection circuit 2*d* have a monophonic selection function for giving a priority to the pitch and each of these detection circuits are constructed to produce the key codes SKC and PKC each corresponding to the key having the highest pitch among the depressed key in each of those keyboards where a plurality of keys in the solo keyboard 1*a* and the pedal keyboard 1*d* are depressed simultaneously. The UK depressed key detection circuit 2*b* and the LK depressed key detection circuit 2*c* are respectively constructed to produce key codes UKC and LKC corresponding to all of the depressed keys in the upper keyboard 1*b* and the lower keyboard 1*c*, whereas to produce a plurality of key codes UKC and LKC corresponding to respective depressed keys when a plurality of keys are depressed simultaneously. Each of the key codes SKC, UKC, LKC and PKC produced by respective depressed key detection circuit 2*a* to 2*d* is constituted by a block code BC representing the octave range of the depressed key and a note code NC representing the note name of the depressed key.

The block code of the key codes UKC, LKC and PKC consists of three bits B3, B2 and B1. One example of the relationship between these bits and the octave range is shown in the following Table 2. The note code NC consists of 4 bits N4, N3, N2 and N1 and one example of the relationship between these bits and the note name is shown in the following Table 3.

TABLE 2

| BC | | | octave range | | |
|---|---|---|---|---|---|
| B3 | B2 | B1 | upper keyboard | lower keyboard | pedal keyboard |
| 0 | 0 | 0 | C2 | C2 | C2 |
| 0 | 0 | 1 | C#2 to C3 | C#2 to C3 | C#2 to C3 |
| 0 | 1 | 0 | C#3 to C4 | C#3 to C4 | C#3 to C4 |
| 0 | 1 | 1 | C#4 to C5 | C#4 to C5 | C#4 to C5 |
| 1 | 0 | 0 | C#5 to C6 | C#5 to C6 | |
| 1 | 0 | 1 | C#6 to C7 | C#6 to C7 | |

TABLE 3

| note | NC | | | | decimal |
|---|---|---|---|---|---|
| name | N4 | N3 | N2 | N1 | representation |
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |

TABLE 3-continued

| note name | NC N4 | N3 | N2 | N1 | decimal representation |
|---|---|---|---|---|---|
| C | 1 | 1 | 0 | 0 | 12 |

While in this table the note code N4–N1 of the note C is represented as "1100" (decimal 12), the code is converted into "1111" (decimal 15) where the note code N4–N1 of the tone C is used for the actual generation of a musical tone. The reason that the note codes N4 to N1 of the tone C were not made to be "1111" for the first time lies in that the data multiplexing circuit 4*b* is constructed to produce a synchronizing data having a content of "1111", i.e. to avoid confusion.

The block code SBC of the key code SKC consists of two bits SB2 and SB1, and one example of the relationship between the content thereof and the octave range is shown in the following Table 4. The note code SNC consists of 4 bits SN4, SN3, SN2 and SN1 and one example of the relationship between the content thereof and the note name is shown in the following Table 5.

TABLE 4

| SBC SB2 | SB1 | octave range |
|---|---|---|
| 0 | 0 | C4 |
| 0 | 1 | C#4 to C5 |
| 1 | 0 | C#5 to C6 |
| 1 | 1 | C#6 to C7 |

TABLE 5

| note name | SNC SN4 | SN3 | SN2 | SN1 | decimal representation |
|---|---|---|---|---|---|
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1 | 1 | 15 |

In this case the note code SN4–SN1 of the note C of the solo keyboard is "1111" (decimal 15).

As shown in Table 2 and 4, the each octave range for which the same block code BC (B3–B1) or SBC (SB2 and SB1) is applicable is not an ordinary octave range of from C to B but is a range of from C# to the higher C.

The key code modification section 3 comprises a key code modification circuit 3*b* which processes (adds or subtracts) the bass pattern data (which is a digital data varying with a desired rhythm) produced by a rhythm pattern generator 3*a* and the key code PKC generated by the PK depressed key detection circuit 2*d*. Accordingly, by depressing only a single key of the pedal keyboard 1*d*, it is possible to produce plural key codes PKC' necessary to produce walking bass tones.

The tone production assignment section 4 is constituted by a tone generation assignment circuit 4*a* and a data multiplexing circuit 4*b*. The tone generation assignment circuit 4*a* operates to assign the key codes UKC, LKC and PKC generated by the depressed key detection circuits 2*b* to 2*d* to available ones of the tone production channels for producing, on a time division basis, key codes KC (UKC, LKC, PKC) assigned to respective channels, and key-on signals KON representing the ON/OFF states of the keys corresponding to the assigned key codes KC for respective channels in accordance with the clock signal $\phi$1 shown in FIG. 3*a*. During key depression, the key-on signal KON is "1", whereas "0" when the key is released.

In this embodiment, the tone production channels are predetermined for respective keyboards and the tone production assignment circuit 4*a* assigns the key codes (UKC, LKC, PKC) of a given keyboard to either one of predetermined tone production channels. One example of the tone production channels to which the key codes UKC, LKC and PKC of the respective keyboards are assigned is shown in the following Table 6.

TABLE 6

| | tone production channel to be assigned |
|---|---|
| key codes UKC of upper keyboard | 2, 4, 5, 7, 10, 13, 16 |
| key codes LKC of lower keyboard | 3, 6, 8, 9, 11, 14, 17 |
| key code PKC of pedal keyboard | 1 |

The 12th, 15th and 18th tone production channels are used for such special performance as an automatic arpeggio, etc., so that the key codes UKC, LKC and PKC would not be assigned to these channels but are assigned with key codes for arpeggio tones. However, since this exclusive allotment is immaterial to the subject matter of this invention, its description will not be made.

Figure 3:
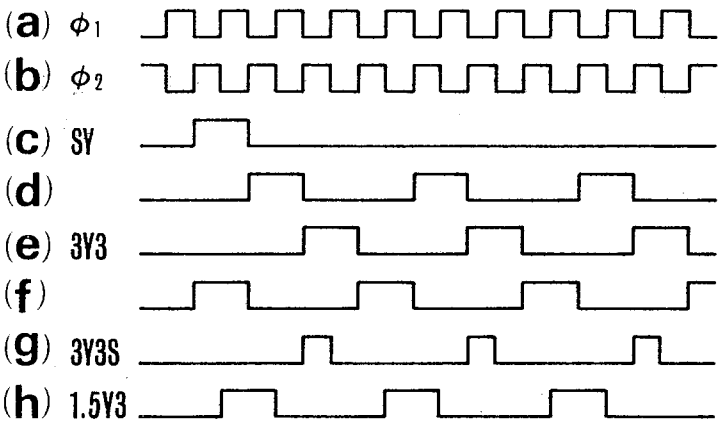
FIGS. 3 and 4 show waveforms of various portions of the timing signal generator shown in FIG. 2.

The data multiplexing circuit 4*b* is constructed to multiplex the key codes KC for respective tone production channels produced by the tone production assignment circuit 4*a* and the key-on signal KON into data MD (4 bits of MD1, MD2, MD3 and MD4) having a number (i.e. 4) of bits smaller than that of the key code KC plus the key-on signal KON. The data multiplexing circuit 4*b* multiplexes the key codes KC and key-on signals KON of the first to 18th tone production channels within respective multiplexing times to produce data MD. As shown in Table 7 below, each multiplexing channel time is constituted by the first to third states (sub-channel times), the unit state corresponding to one period of the clock signal $\phi$1 (FIG. 3*a*). For this reason, each multiplexing time has a time width corresponding to 3 periods of the clock signal $\phi$1.

During the first state of the first multiplexing channel time, the first musical tone signal generator 6 and the highest key detection circuit 7 generate a synchronizing data "1111" which is used for demodulating the multiplexed data MD. During the second state of each multiplexing channel time, the block codes B1 to B3 of the key code KC and the key-on signal KON are transmitted by the bits MD1 to MD4. Furthermore, during the third state of each multiplexing channel time, the note codes N1 to N4 of the key code KC are transmitted with the bits MD1 to MD4.

In Table 7, UK, LK and PK represent the channels to which the key codes (UKC, LKC, PKC) of the upper, lower and pedal keyboards respectively are assigned.

TABLE 7

| channel time | | 1 | | | 2 | | |
|---|---|---|---|---|---|---|---|
| state | | 1 | 2 | 3 | 1 | 2 | 3 |
| MD | MD1 | "1" | B1 | N1 | "0" | B1 | N1 |
| | MD2 | "1" | B2 | N2 | "0" | B2 | N2 |
| | MD3 | "1" | B3 | N3 | "0" | B3 | N3 |

TABLE 7-continued

| | | | | | | |
|---|---|---|---|---|---|---|
| MD4 | "1" | KON | N4 | "0" | KON | N4 |
| keyboard tone production channel | | PK 1 | | | UK 4 | |
| channel time | | 3 | | | 4 | |
| state | 1 | 2 | 3 | 1 | 2 | 3 |
| MD MD1 | "0" | B1 | N1 | "0" | B1 | N1 |
| MD2 | "0" | B2 | N2 | "0" | B2 | N2 |
| MD3 | "0" | B3 | N3 | "0" | B3 | N3 |
| MD4 | "0" | KON | N4 | "0" | KON | N4 |
| keyboard tone production channel | | UK 7 | | | UK 10 | |
| channel time | | 5 | | | 6 | |
| state | 1 | 2 | 3 | 1 | 2 | 2 |
| MD ND1 | "0" | B1 | N1 | "0" | B1 | N1 |
| ND2 | "0" | B2 | N2 | "0" | B2 | N2 |
| MD3 | "0" | B3 | N3 | "0" | B3 | N3 |
| MD4 | "0" | KON | N4 | "0" | KON | N4 |
| keyboard tone production channel | | UK 13 | | | UK 16 | |
| channel time | | 7 | | | 8 | |
| state | 1 | 2 | 3 | 1 | 2 | 3 |
| MD MD1 | "0" | B1 | N1 | "0" | B1 | N1 |
| MD2 | "0" | B2 | N2 | "0" | B2 | N2 |
| MD3 | "0" | B3 | N3 | "0" | B3 | N3 |
| MD4 | "0" | KON | N4 | "0" | KON | N4 |
| keyboard tone production channel | | UK 2 | | | UK 4 | |
| channel time | | 9 | | | 10 | |
| state | 1 | 2 | 3 | 1 | 2 | 3 |
| MD MD1 | "0" | B1 | N1 | "0" | B1 | N1 |
| MD2 | "0" | B2 | N2 | "0" | B2 | N2 |
| MD3 | "0" | B3 | N3 | "0" | B3 | N3 |
| MD4 | "0" | KON | N4 | "0" | KON | N4 |
| keyboard tone production channel | | LK 8 | | | LK 11 | |
| channel time | | 11 | | | 12 | |
| state | 1 | 2 | 3 | 1 | 2 | 3 |
| MD MD1 | "0" | B1 | N1 | "0" | B1 | N1 |
| MD2 | "0" | B2 | N2 | "0" | B2 | N2 |
| MD3 | "0" | B3 | N3 | "0" | B3 | N3 |
| MD4 | "0" | KON | N4 | "0" | KON | N4 |
| keyboard tone production channel | | LK 14 | | | LK 17 | |
| channel time | | 13 | | | 14 | |
| state | 1 | 2 | 3 | 1 | 2 | 3 |
| MD MD1 | "0" | B1 | N1 | "0" | B1 | N1 |
| MD2 | "0" | B2 | N2 | "0" | B2 | N2 |
| MD3 | "0" | B3 | N3 | "0" | B3 | N3 |
| MD4 | "0" | KON | N4 | "0" | KON | N4 |
| keyboard tone production channel | | LK 3 | | | LK 6 | |
| channel time | | 15 | | | 16 | |
| state | 1 | 2 | 3 | 1 | 2 | 3 |
| MD MD1 | "0" | B1 | N1 | "0" | | |
| MD2 | "0" | B2 | N2 | "0" | | |
| MD3 | "0" | B3 | N3 | "0" | | |
| MD4 | "0" | KON | N4 | "0" | | |
| keyboard tone production channel | | LK 9 | | | 12 | |
| channel time | | 17 | | | 18 | |
| state | 1 | 2 | 3 | 1 | 2 | 3 |
| MD MD1 | "0" | | | "0" | | |
| MD2 | "0" | | | "0" | | |
| MD3 | "0" | | | "0" | | |
| MD4 | "0" | | | "0" | | |
| keyboard tone production channel | | 15 | | | 18 | |

The first tone production system 6 operates to demodulate the multiplexed data MD (MD1 to MD4) send from the tone production assignment section 4 to derive out in parallel the key codes KC and the key-on signals KON for respective tone producing channels so as to cause the same to produce musical tone signals having corresponding tone pitches based on the key codes KC and at timings determined by the key-on signals KON of the respective channels. The musical signals thus generated are supplied to a sound system (not shown) through the mixing resistor 5 thereby producing musical tones corresponding to the depressed keys in the upper, lower and pedal keyboards.

The highest key detection unit 7 is constituted by a key code conversion circuit *7a*, a first highest key detection circuit *7b*, a second highest key detection circuit *7c*, a key code memory device *7d* and a key-on detection circuit *7e*. The key code conversion circuit *7a* converts the key codes KC of the respective tone production channels produced by the tone production assignment unit 7 as multiplexed data MD into codes in accordance with the output of the intermanual coupler selection switch unit *7f*. The intermanual coupler selection switch *7f* selects one of the upper, lower and pedal keyboards to be coupled to the second tone production system 8 as the intermanual coupler. Coupler selections which unit *7f* is provided with a UK selection switch UCS for selecting the upper keyboard, an LK selection switch LCS for selecting the lower keyboard and a PK selection switch PCS for selecting the pedal keyboard. With this construction, upon turning ON the UK selection switch UCS or the LK selection switch LCS, the key code conversion circuit *7a* selects key codes KC within the tone range of the solo keyboard (C4 to C7 in Table 1) from among the key codes KC of the upper or lower keyboard delivered from the tone production assignment section 4 as multiplexed data and the selected key codes are converted so as to match with the key codes SKC of the solo keyboard for comparing the selected key codes with the key codes SKC in the second highest key detection unit *7c*. More particularly, three bit block codes B1 to B3 (Table 2) constituting the key code KC are converted into block codes B1′ and B2′ corresponding to the 2 bit block codes SB1 and SB2 shown in Table 4, and the note codes N1 to N4 (Table 3) are converted into note codes N1′ to N4′ corresponding to the note codes SN1 to SN4 shown in Table 5. When the PK selection switch PCS is ON, the key code convertion circuit *7a* preferentially selects only the key code regarding the pedal keyboard, that is the key code PKC among the key codes produced by the tone production assignment section 4 as the multiplexed data MD and converts the block codes B1 to B3 (Table 2) of the key code PKC into block codes B1′ and B2′ corresponding to the two bit block codes SB1 and SB2 shown in Table 4. Further, the key code conversion circuit *7a* converts the note codes N1 to N4 (Table 3) into note codes N1′ to N4′ corresponding to the note codes SN1 to SN4 shown in Table 5. At this time, as shown in Table 4, the block codes SB1 and SB2 of the key code SKC take the charge of the note range of from C4 to C7, whereas the block codes B1 to B3 of the key code PKC take the charge of the note range of from C2 to C5 as shown in Table 2 so that when the block codes B1 to B3 of the key code PKC are converted into the block codes SB1 and SB2 (B1' and B2') shown in Table 4, these block codes are converted into codes shifted by two octaves. These codes, however, are corrected by the second tone production system 8 as will be described later.

The key code conversion circuit 7a detects the aforementioned synchronizing data "1111" contained in the multiplexed data MD produced by the tone production assignment section 4 so as to supply the detected synchronizing signal to the timing signal generator 9 to act as a synchronizing signal SY thereby synchronizing the operation of the timing signal generator 9.

The first highest key detection circuit 7b operates to produce, as a coupler key code, only a key code corresponding to a key having the highest pitch among converted key codes KC' produced by the key code conversion circuit 7a. Further, when the PK selection switch PCS is ON, the highest key detection circuit 7b produces only one converted key code KC' regarding the pedal keyboard as a coupler key code CKC without any modification. The second highest key detection circuit 7c compares the key code SKC produced by the SK depressed key detection circuit 2a with a coupler key code CKC produced by the first highest key detection circuit 7b so as to deliver the key code having higher tone pitch (higher one of SKC and CKC) as a key code MKC. The key code memory device 7d temporarily stores the key code MKC delivered from the second highest key detection circuit 7c and then supply it to the second tone production system 8.

The purpose of the key-on detection circuit 7e is to detect the state of the key code memory device 7d to produce an inverted key-on signal $\overline{\text{MKON}}$ and further to compare the key code MKC supplied to the key code memory device 7d with the memory output key code MKC. When these key codes coincide with each other, the inverted key-on signal $\overline{\text{MKON}}$ ("0") is produced, whereas in the case of noncoincidence the inverted key-on signal $\overline{\text{MKON}}$ is not produced ($\overline{\text{MKON}}$="1"). This inverted key-on signal $\overline{\text{MKON}}$ is applied to the second tone production system 8.

The second tone production system 8 is constituted by a key code/pitch-voltage conversion circuit 8a, a voltage controlled type variable frequency oscillator 8b (hereinafter called VCO 8b), a voltage controlled type variable filter (VCF) 8c, a voltage controlled type variable amplifier (VCA) 8d and envelope waveform generators (EG) 8e and 8f respectively controlling the VCF 8c and VCA 8d.

The key code/pitch-voltage conversion circuit 8a converts the key code MKC (having a digital value) produced by the key code memory device 7d of the highest key detection unit 7 into a corresponding tone pitch voltage KV of an analogue quantity which is applied to VCO 8b, which generates a tone source signal having a frequency corresponding to the tone pitch voltage KV, the generated tone source signal being supplied to VCF 8c.

The EG 8e and 8f are operated by the inverted key-on signal $\overline{\text{MKON}}$ ("0") produced by the key-on detection circuit 7e so as to generate such envelope control waveforms EW1, EW2 having an attack, sustain, decay, and release shapes, and supply the generated envelope control waveforms to VCF 8c and VCO 8b. As a consequence, the tone source signal produced by the VCO 8b is imparted with a tone color by VCF 8c according to the envelope control waveform EW1 and with an amplitude envelope by VCA 8d according to the envelope control waveform EW2. The musical tone signal imparted with the tone color and amplitude envelopes in this manner is sent to the sound system (not shown) via the mixing resistor 5 to be produced as a musical sound.

When the PK selection switch PCS of the intermanual coupler selection switch unit 7f is ON, the VCO 8b is controlled by the output signal "1" of the PK selection switch PCS such that its oscillation frequency decreases by 3 octaves, whereby the frequency of the generated musical tone is lowered by 3 octaves. This reduces 3 octaves which were increased at the time of key code conversion effected by the key code conversion circuit 7a back to the usual 16' bass tone range for the key range of C2 to C5 in Table 2. The timing signal generator 9 operates in synchronism with the synchronizing signal SY produced by the above described tone production assignment section 4 for producing various timing signals which control the depressed key detection circuits 2a to 2d, the tone production assignment section 4, the first tone production system 6, the highest key detection unit 7, etc, thereby providing a reference for the operation of the electronic musical instrument.

Having described the outline of the illustrated embodiment of the electronic musical instrument, the circuit components thereof will be described in detail in the following. The UK and LP depressed key detection circuits 2b and 2c are disclosed in U.S. Pat. No. 4,148,017 to Tomimasa, the key coder modification section 3 is disclosed in copending U.S. patent application Ser. No. 825,443 filed by Hiyoshi et al on Aug. 17, 1977, now U.S. Pat. No. 4,184,401, and the tone production assignment section 4 (tone production assignment circuit 4a and the data multiplexing circuit 4b) and the first tone production system 6 are disclosed in copending U.S. patent application Ser. No. 929,007 filed on July 28, 1978 by Yamaga et al, now U.S. Pat. No. 4,184,401. Accordingly, in the following, these component elements will not be described.

A Timing Signal Generator 9

Figure 2:
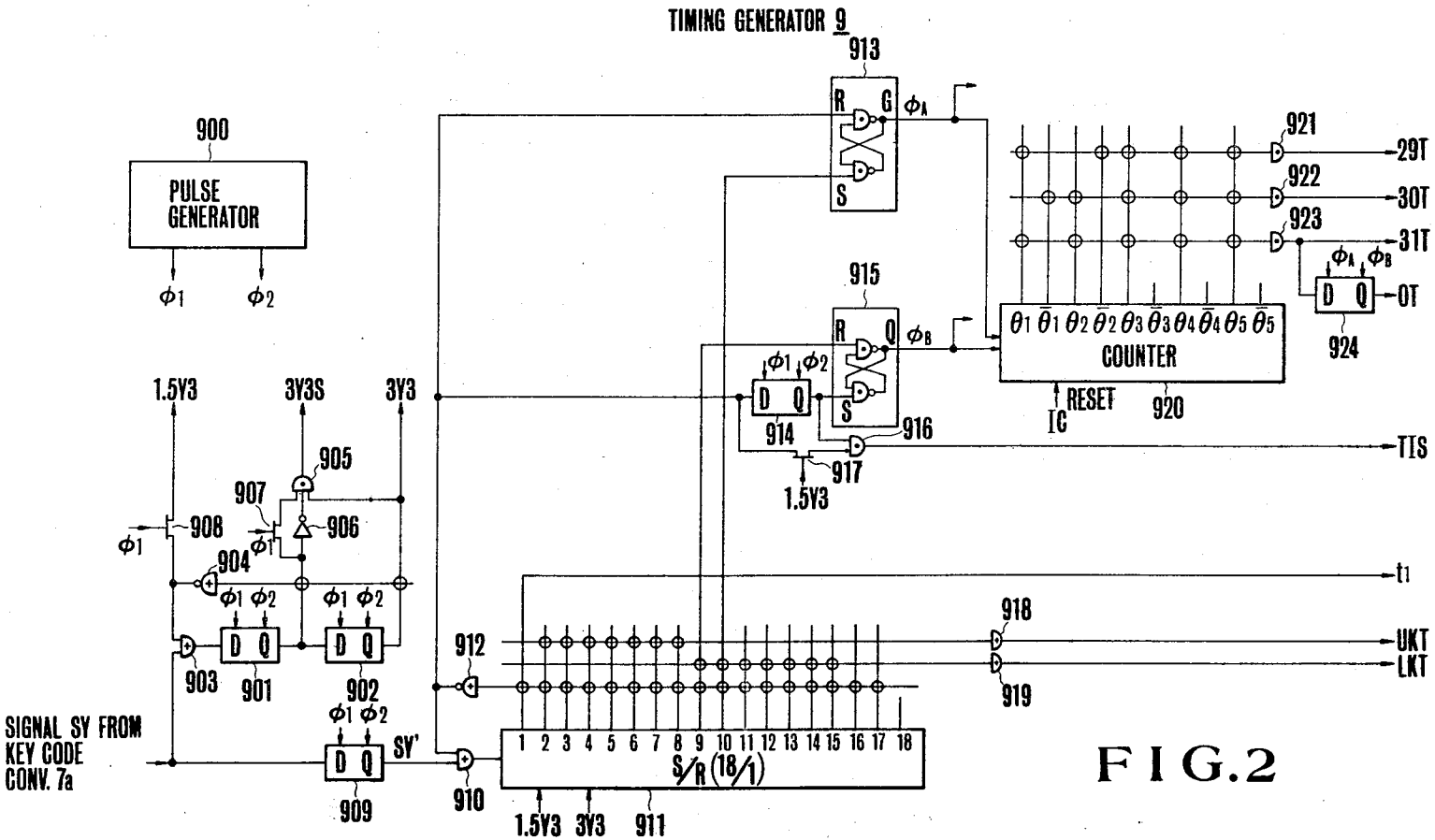
FIG. 2 is a schematic diagram showing the timing signal generator shown in FIG. 1.

The principal elements of the timing signal generator 9 are shown in FIG. 2, which generates various timing signals acting as reference in the operation of the electronic musical instrument. The timing signal generator 9 comprises a pulse generator 900 which generates two phase clock signals $\phi$1 and $\phi$2 having opposite phases as shown in FIGS. 3a and 3b, and a serially connected delay flip-flop circuits 901 and 902 which are operated by clock pulses $\phi$1 and $\phi$2. The delay flip-flop circuit 901 is supplied, via OR gate circuit 903, with the synchronizing signal SY (FIG. 3c) which is produced by detecting the synchronizing data as "1111" in the first state during the first multiplex channel time of the multiplexed data MD shown in Table 7 produced by the key code conversion circuit 7a described above. The output signals of the delay flip-flop circuits 901 and 902 are supplied to a NOR gate circuit 904 which supplies "1" to the delay flip-flop circuit 901 via the OR gate circuit 903 when the both outputs of the delay flip-flop circuits become "0", thereby constituting a circulating type shift register of two bit construction. Accordingly, when a synchronizing signal SY synchronous with the clock signal $\phi$3 and having a pulse width corresponding to one period of the clock signal $\phi$2 as shown in FIG. 3c is supplied to the delay flip-flop circuit 901 via the OR gate circuit 903, the flip-flop circuit 901 would be applied with the synchronizing signal by the timing action of the clock signal $\phi$1 and then produce the synchronizing signal by the timing action of the clock signal $\phi$2. Consequently, a signal delayed from the synchronizing signal SY by one bit time (one period of the clock signal $\phi$1 and $\phi$2) can be obtained as shown in FIG. 3*d*. This output signal (FIG. 3*d*) produced by the delay flip-flop circuit 901 is applied to the delay flip-flop circuit 902 and outputted therefrom after being delayed by one bit time. When the outputs of the delay flip-flop circuits 901 and 902 become "0", the output signal of the NOR gate circuit 904 becomes "1" as shown in FIG. 3*f*, and this output signal "1" is again supplied to the delay flip-flop circuit 901 via the OR gate circuit 903 by the timing action of the clock signal $\phi$1, thus continuing the operation in the same manner as above described. Consequently, the delay flip-flop circuit 902 produces an output signal (FIG. 3*e*) having a frequency equal to $\frac{1}{3}$ of the frequency of the clock signal $\phi$1 in synchronism with the synchronizing signal SY, the output signal being delivered as a timing signal 3Y3 which shows the timing of the third state during each multiplex channel time of the multiplexed data MD shown in Table 7 and produced by the data multiplexing circuit 4*b*. Consequently, by latching the multiplexed data MD with the timing signal 3Y3, the note codes N1 to N3 of the key code assigned to each tone production channel can be taken out. An AND gate circuit 95 is inputted with a signal obtained by inverting the timing signal 3Y3 (FIG. 3*e*) and the output signal (FIG. 3*d*) of the delay flip-flop circuit 901, and the output signal of the delay flip-flop circuit 901 which is supplied via a field effect transistor 907 (which is turned ON by the timing action of the clock signal $\phi$1. Since the output line of the field effect transistor 907 is connected to the AND gate circuit 905 having a high input impedance it continues to hold the input condition at the time of application of the clock signal $\phi$1 (that is the output of the delay flip-flop circuit 901) by the stray capacitance of the output line until the next clock signal $\phi$1 is supplied. As a consequence, as shown in FIG. 3*g*, the AND gate circuit 905 produces a timing signal 3Y3S (signal obtained by differentiating the building up portion of the timing signal 3Y3) wherein the output signal becomes "1" for one half period of the clock signal $\phi$1 after the building up of the timing signal 3Y3 shown in FIG. 3*e*.

The output signal of the NOR gate circuit 904 shown in FIG. 3*f* is delivered out through a field effect transistor 908 which is turned ON by the clock signal $\phi$1. The output line of the field effect transistor 908 is connected to a load (logic circuit) having a high input impedance so that it continues to hold the input condition at the time of application of the clock signal $\phi$1 (the output of the NOR gate circuit) by the stray capacitance of the output line until the next clock signal $\phi$1 is applied. Accordingly, the transistor 908 produces a timing signal 1.5Y3 obtained by delaying the timing signal 3Y3 (FIG. 3*e*) by 1.5 periods of the clock signal $\phi$1.

The synchronizing signal SY is delayed by one bit (one period of the clock signal $\phi$1) by the delay flip-flop circuit 909 driven by the clock signals $\phi$1 and $\phi$2 and then supplied to a shift register 911 having 18 stages, the number of stages being number of the tone production channels described above. The shift register 911 receives the input signal according to the timing signal 1.5Y3 (FIG. 3*h*) and its content is shifted by the timing signal 3Y3 (FIG. 3*e*). For the purpose of matching the timing signal 1.5Y3 for causing the shift register 911 to accept its input signal, the synchronizing signal SY is delayed one bit time by the delay flip-flop circuit 909, and the delayed synchronizing signal SY is applied to the shift register 911 via OR gate circuit 910. The shift register 911 takes in a signal "1" by the timing signal 1.5Y3 and the received signal "1" (SY') is shifted sequentially by the timing signal 3Y3 (FIG. 3*e*). Consequently, the outputs at respective stages of the shift register 911 represents the first to 18th multiplex channel times shown in Table 7 to be described later. When this "1" signal is shifted to the 18th stage of the shift register 911, the output of NOR gate circuit 912 inputted with the outputs at the first to 17th stages of the shift register 911 becomes "1" which is supplied to the input terminal of the shift register 911 via the OR gate circuit 910 thus forming a circulation type shift register. When the signal "1" received by the shift register 911 is sequentially shifted up to the 10th stage, this stage produces an output "1", and the flip-flop circuit 913 is set to produce a Q output "1". When the signal is further shifted until the output of the 18th stage becomes "1", the NOR gate circuit 912 produces "1" which the flip-flop circuit 913, whereby its output becomes "0". Furthermore when the signal received by the shift register 911 is shifted to the 18th stage, the NOR gate circuit 912 produces an output "1", which in turn is delayed by one bit time by the delay flip-flop circuit 914 and then sets the flip-flop circuit 915 causing it to produce Q output of "1". When the output of the 9th stage of the shift register 911 becomes "1", the flip-flop circuit 915 is reset to produce "0" Q output. As shown as the clock signal $\phi$A in FIG. 4*a*, the output Q of the flip-flop circuit 913 becomes "1" during an interval in which either one of the outputs from the 10th to 17th stages of the shift register 911 becomes "1". As shown as the clock signal $\phi$B in FIG. 4*b*, the output Q of the flip-flop circuit 915 becomes "1" during an interval in which either one of the outputs from the first to the 8th stages of the shift register 911 is "1". The AND gate circuit 916 is inputted with the output signal of the delay flip-flop circuit 914 and the output of the NOR gate circuit 912 which is supplied through a field effect transistor 917 turned ON by the timing action of the timing signal 1.5Y3. Since the output line of the field effect transistor 917 is connected to the AND gate circuit 916 having a high input impedance, the input condition, i.e. the output of the NOR gate circuit 912 at the time of generating the timing signal 1.5Y3 would be held by the stray capacitance of the output line until the next timing signal 1.5Y3 is generated. Consequently, the signal outputted by the AND gate circuit 916 becomes "1" during the fore half period of the interval in which the first stage of the shift register 911 is produced as shown as the timing signal TIS in FIG. 4*c*, the "1" signal representing the building up portion of the first multiplex channel time.

Figure 4:
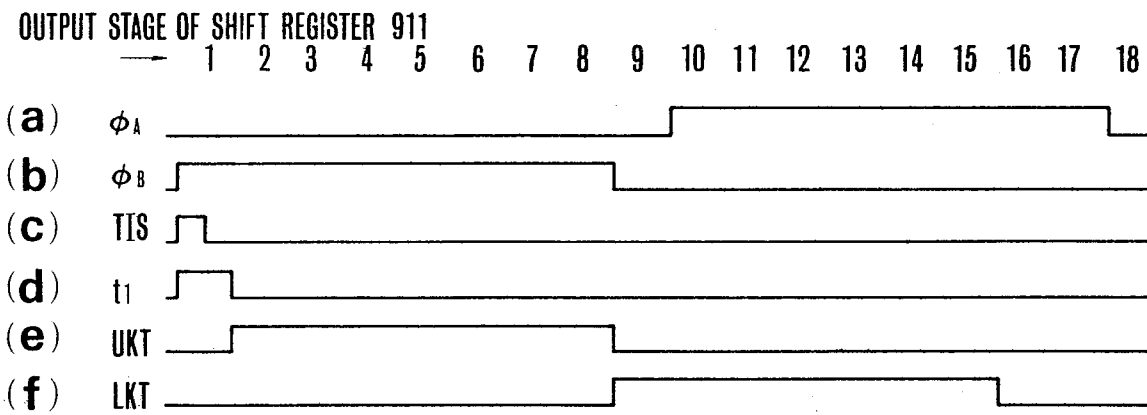

As shown in FIG. 4*d*, the first stage output of the shift register 911 is produced as a timing signal t1 representing the first multiplex channel time (corresponding to the tone producing channel for the pedal keyboard). The outputs from the second to the 8th stages of the shift register 911 is produced by the OR gate circuit 918 as a timing signal UKT representing the second to 8th multiplex channel times (corresponding to the tone producing channels for the upper keyboard) shown in Table 7, as shown in FIG. 4*e*. The 9th to 15th stage outputs of the shift register 911 are produced as the timing signal LKT representing the 9th to 15th multiplexing channel times (corresponding to the tone production channels for the lower keyboard) of Table 8 via the OR gate circuit 919 as shown in FIG. 4*f*.

A 5 bit binary counter 920 reset by an initial clear signal IC produced at the time of closing a source circuit sequentially counts up a signal produced by the flip-flop circuit 913 according to clock signals $\phi$A and $\phi$B. In other words, the counter 920 makes one count at each one period of the shift register 911. To the output of counter 920 are connected AND gate circuit 921, 922 and 923 which respectively produce timing signals 29T, 30T and 31T each time the count of the counter 920 reaches decimal values 29, 30 and 31 respectively. The timing signal 31T produced by the AND gate circuit 923 is delayed by one count time (corresponding to one period of the shift register 911) of the counter 920 by the delay flip-flop circuit 924 driven by the clock signals $\phi$A and $\phi$B, thereby producing a timing signal OT.

B Depressed Key Detection Circuit 2*a*

Figure 5:
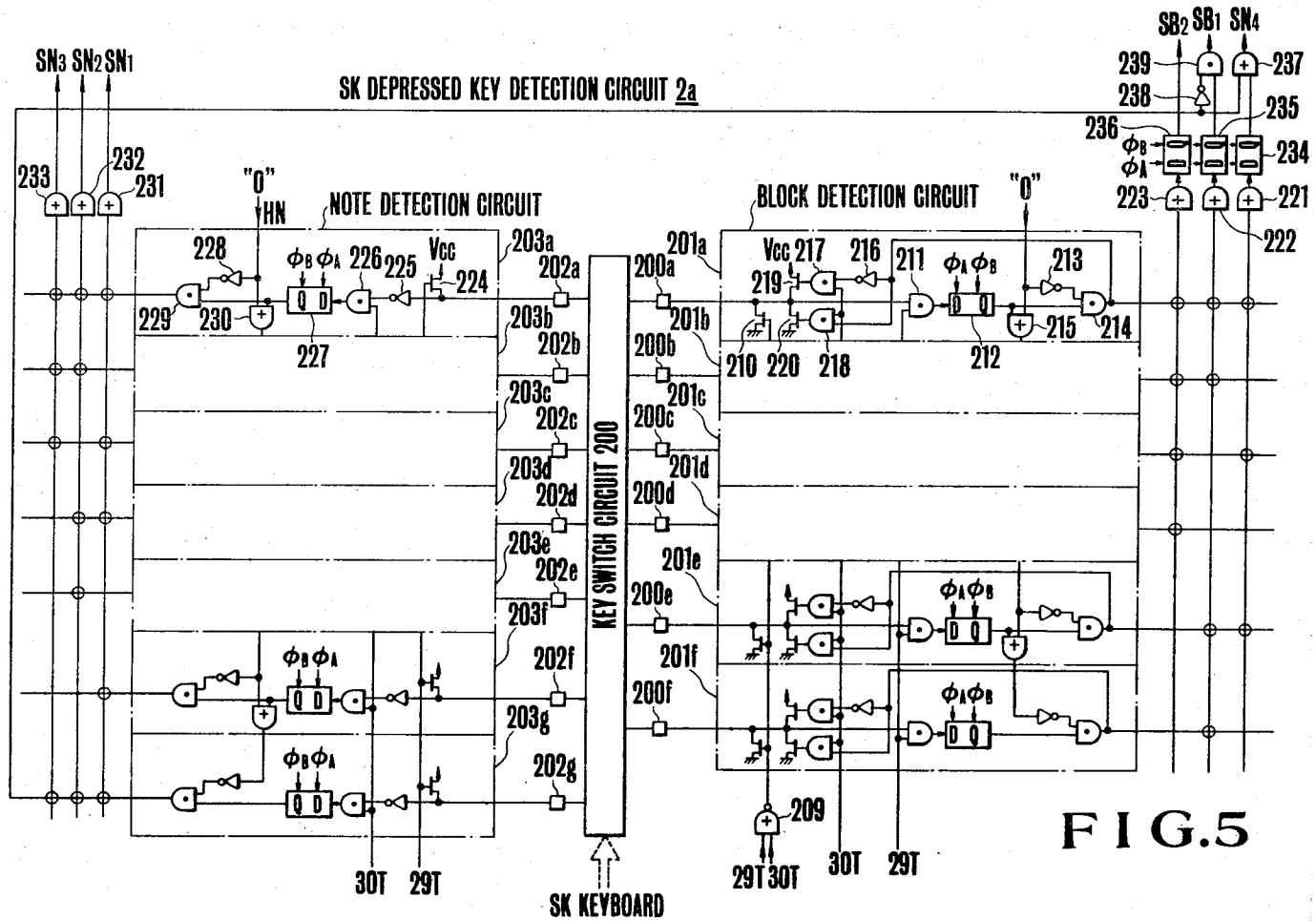
FIG. 5 is a schematic diagram showing one example of the SK depressed key detection circuit shown in FIG. 1.
Figure 6:
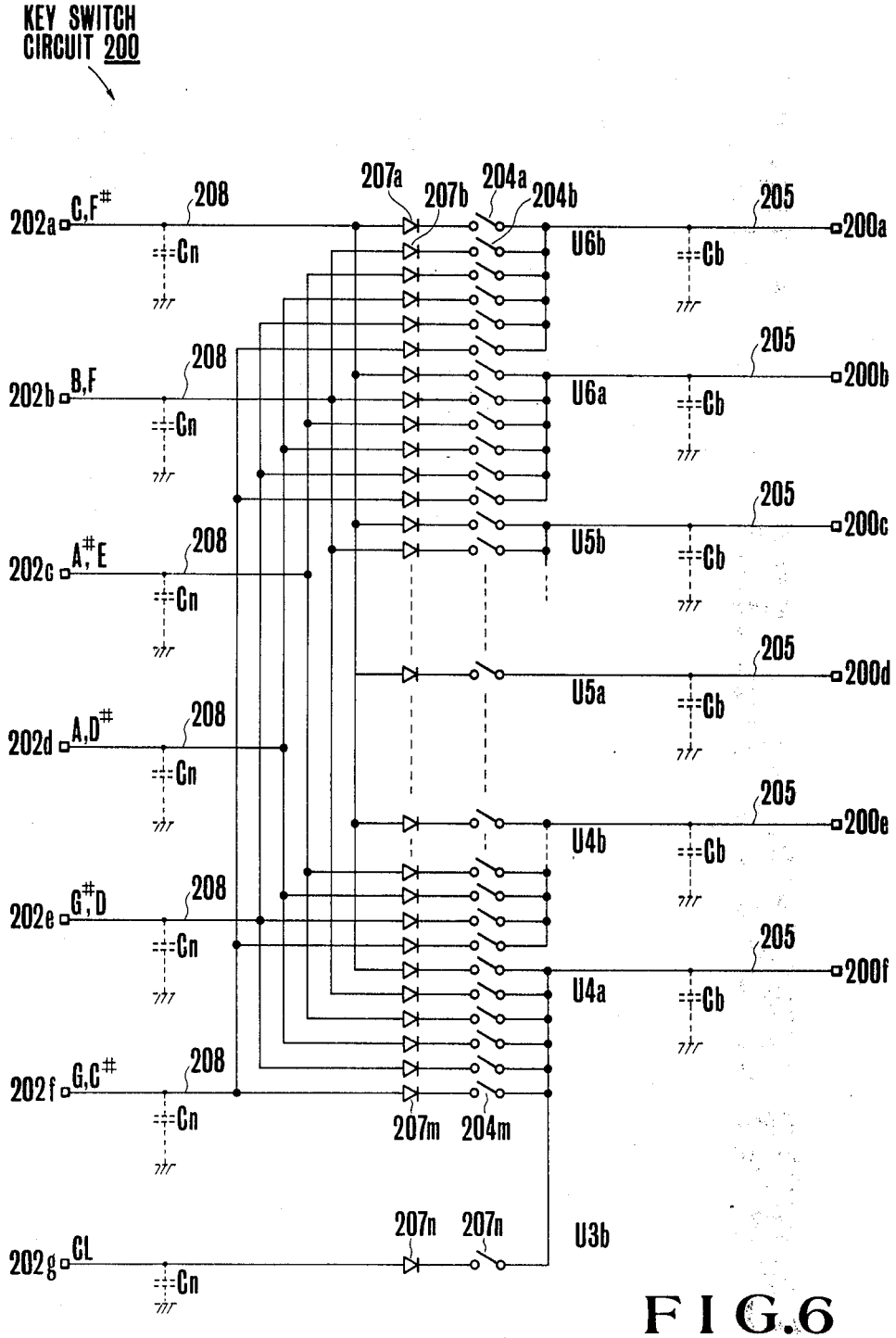
FIG. 6 is a schematic diagram showing one example of the key switch circuit shown in FIG. 5.

FIG. 5 is a schematic diagram showing the detail of one example of the SK depressed key detection circuit 2*a* shown in FIG. 1 which comprises a key switch circuit 200, block detection circuits 201*a* to 201*f* respectively connected to the combined block input/output and terminals 200*a* to 200*f* of the key switch circuit 200 and note detection circuits 203*a* to 203*g* respectively connected to the combined note input/output and terminals 202*a* to 202*g* of the key switch 200. As shown in FIG. 6, the key switch circuit 200 comprises 37 key switches 204*a* to 204*n* corresponding to respective keys of the solo keyboard, one side terminals (movable contacts) of 36 key switches 204*a* to 204*m*, except that of a key switch 204*n* corresponding to C note of the lowest octave are commonly connected for each group of a half octave (C# to F or G to C) to form five blocks U4*a*, U4*b*, U5*b*, U6*a* and U6*b*, which are connected to input/output terminals 200*a* to 200*f* via block wirings 205. The other side or stationary contacts of the key switches 204*a* to 204*n* are commonly connected for respective note combinations C and F#, B and F, A# and E, A and D#, G# and D, and G and C# via diodes 207*a* to 207*m* for preventing interference, and these combinations are connected to note input/output terminals 202*a* to 202*f* via wirings 208. In this example, the number of the keys of the solo keyboard 1*a* is 37 consisting of C4 to C7, as shown in Table 1. Where these keys are divided into 6 blocks (U4*a* to U6*b*) for respective half octaves there is an inconvenience that the key switch 204*n* for the C note key of the lowest octave would become surplus. However, addition of one block for such surplus key switch 204*n* increases cost. For this reason, in the embodiment shown in FIG. 6 the key switch 204*n* for the C note key of the lowest octave is included in block U4*a* as a CL note so that this block 4*a* alone is in charge of 7 key switches. Consequently, the movable contact of the key switch 204*n* is conneced to a block input/output terminal 200*f* via a block wiring 205, whereas the stationary contact is connected to a note input/output terminal 202*g* (produced for the CL note alone) via a note wiring 208. Generally, as the key switches are mounted on a keyboard, the lengths of the block wirings 205 and of the note wirings 208 which interconnect the key switches 204*a* to 204*n* and block detection circuits 201*a* to 201*f* and note detection circuit, 203*a* to 203*g* are large so that wiring capacitances Cb and Cn are inevitable. In this embodiment, unique utilization of these wiring capacitances is contemplated.

Although the detail of the block detection circuits 201*a* to 201*f* (FIG. 5) is shown only for circuits 201*a*, 201*e* and 201*f*, it should be understood that other circuits 201*b* to 201*d* are identical. The block detection circuits 201*a* to 201*f* are connected between the block input/output terminals 200*a* to 200*f* and the ground. Each block detection circuit is constituted by a NOR gate circuit 209 supplied with the timing signals 29T and 30T from the timing signal generator 9 shown in FIG. 2, a field effect transistor 210 supplied with the output of the NOR gate circuit 209, an AND gate circuit 211 with its inputs connected to receive the output of a corresponding one of the block input/output terminals (200*a* to 200*f*) and the timing signal 29T, a delay flip-flop circuit 212 which produces the output of the AND gate circuit 211 by the timing action of the clock signal $\phi$A, an AND gate circuit 214 with its inputs connected to receive the output of the delay flip-flop circuit and a signal HB obtained by inverting a higher block priority signal HB by an inverter 213, an OR gate circuit 215 connected to receive the output of the delay flip-flop circuit 212 and the higher block priority signal HB and to supply its output to a lower order block as a new higher block priority signal HB, an AND gate circuit 217 supplied with a signal produced by inverting the output of the AND gate circuit 214 by an inverter 216 and the timing signal 30T, an AND gate circuit 218 connected to receive the output of the AND gate circuit 214 and the timing signal 30T, a field effect transistor 219 connected between a source Vcc and corresponding one of the block input/output terminals (200*a* to 200*f*) and supplied with the output of the AND gate circuit 217 as a gate input, and a FET transistor 220 connected between the ground and corresponding one of the block input/output terminals 200*a* to 200*f* and supplied with the output of the AND gate circuit 218 as the gate input.

The higher block priority signal HB applied to the inverter 203 of the block detection circuit 201*a* is normally "0" because there is no block detection circuit at an order higher than the block detection circuit 201*a*. No OR gate circuit 215 is provided for the block detection circuit 201*f* because there is no detection circuit as a lower order.

The outputs of the AND gate circuits 214 of the block detection circuits 201*a* and 201*f* are derived not through OR gate circuits 221 to 223 as a block code. The detail of the note detection circuits 203*a* to 203*g* is shown only for circuits 203*a*, 203*f* and 203*g*, but it will be clear that another circuits 203*b* to 203*c* have the same construction.

Each of the note detection circuits 203*a* to 203*g* comprises a field effect transistor 224 connected between the source Vcc and corresponding one of the note input/output terminals 202*a* and 202*g* and supplied with the timing signal 29T as a gate input, an AND gate circuit 226 with its inputs connected to receive a signal produced by inverting the output of corresponding one of the note input/output terminals 202*a* to 202*g* by an inverter 225, and the timing signal 30T, a delay flip-flop circuit 227 supplied with the output of the AND gate circuit 226 by the timing action of the clock pulse $\phi$A and produces an output according to clock pulse $\phi$B, an AND gate circuit 229 supplied with a signal $\overline{HN}$ produced by inverting a higher note priority signal HN by an inverter 228 and the output of the delay flip-flop circuit 227, and an OR gate circuit 230 supplied with the higher note priority signal HN and the output of the delay flip-flop circuit 227 for supplying its output to a lower order note detection circuit as a new higher note priority signal HN.

The higher note priority signal HN supplied to the inverter 228 of the note detection circuit 203*a* is always "0" because there is a higher order note detection circuit. In the same manner, no OR gate circuit is provided for the note detection circuit 203*g* because there is no lower order note detection circuit.

The output of the AND gate circuit 229 of each one of the note detection circuits 203*a* to 203*g* is derived out as an encoded signal through a corresponding one of the OR gate circuits 231 and 233.

The timing signals 29T and 30T generated by the timing signal generator 9 shown in FIG. 2 are applied to the SK depressed key detection circuit 2*a* described above. The NOR gate circuit 209 produces an "1" signal during an interval other than the times at which the timing signals 29T and 30T are produced. This output "1" is used to turn ON the field effect transistor 210 of each one of the block detection circuits 201*a* to 201*f* to discharge the stray capacitance Cb of the block wiring.

Upon reception of the timing signal 29T from the timing signal generator 9 (FIG. 2), transistors 224 of the respective note detection circuits 203*a* and 203*g* are turned ON with the result that the stray capacitance of the note wirings 204 are discharged via respective note input/output terminals 202*a* to 202*g*. At this time, when either one or a plurality of key switches 204*a* to 204*n* (FIG. 6) are closed due to the operation of a key or keys, the stray capacitance Cb of the corresponding block wiring 205 would be charged through the closed key switch 204. As a consequence, one of the block input/output terminals 200*a* to 200*f* of a block to which the closed switch 204 belongs becomes "1" so that the AND gate circuit 211 of the block detection circuit 201 connected to that terminal produces a "1" signal when the timing signal 29T is generated showing that the key switch of that block is in an ON stage. This "1" output signal of the AND gate circuit 211 is delayed by the first to 18th multiplexing channel times by the flip-flop circuit 212 driven by the clock signals $\phi$A and $\phi$B and delivered out by the flip-flop circuit 212 in synchronism with the timing signal T30. When the delay flip-flop circuit 212 produces an "1" output signal, the higher block priority circuit constituted by the inverter 213, AND gate circuit 214 and OR gate circuit 215 causes the AND gate circuit 214 to produce signal "1" of the block detection circuit 201 having the highest priority order among the block detection circuits 201 to which the output "1" of the delay flip-flop circuit 212 has been applied. In this embodiment, the order of the block detection circuits 201 is 201*a*, 201*b*, 201*c*. . . 201*f*. At this time, in a block detection circuit 201 having a lower order of priority, as the output signal of the delay flip-flop circuit 212 of the higher order block detection circuit 201 is applied to the inverter 213 via OR gate circuit to act as the higher block priority signal HB, the AND gate circuit 214 is disabled. In the block detection circuit 201 whose AND gate circuit 214 is sending out the signal "1", the output of the AND gate circuit 218 becomes "1" upon generation of the timing signal 30T, and this output "1" turns ON the field effect transistor 220. In the block detection circuit 201 whose AND gate circuit 214 is sending out a signal "0" the field effect transistor 219 is enabled by a "1" signal produced by the AND gate circuit 217 at the time of generator of the timing signal. As a consequence, after transistor 220 has become enabled, one of the block input/output terminals 200*a* to 200*f* connected to the block detection circuit 201 would be grounded thus becoming to "0" level. Consequently, the charge of the stray capacitance Cn of the note wiring 205 corresponding to the closed key switch 204 of that block is discharged so that the note input/output terminal 202 connected to the note wiring 208 would also become to "0" level. As a consequence, the output of only inverter 225 of the note detection circuit 203 connected to the note input/output terminal 202 which has become "0" level becomes "1". At this time, since the timing signal 30T is being generated, this output "1" of the inverter 225 applied to the delay flip-flop circuit 227 via AND gate circuit 226 and the delayed output is produced by the delay flip-flop circuit in synchronism with the next timing signal 32T. In response to this "1" output signal, signal "1" is produced from only the AND gate circuit 229 of the note detection circuit 203 having the highest order of priority (in this embodiment the order of the note detection circuits is 203*a*, 203*b*, 203*c* . . . *203g*) among the note detection circuits which are supplied with the signal "1" from the delay flip-flop circuit 227 due to the operation of the higher note priority circuit constituted by inverter 228, AND gate circuit 229 and OR gate circuit 230. In a note detection circuit 203 having a lower order of priority, the AND gate circuit 229 disabled by a higher note priority signal HN ("1") produced by the OR gate circuit 230. In this manner, the signal "1" produced by one note detection circuit 203 is encoded through OR gate circuits 231 and 233 and outputted in synchronism with the timing signal 31T as bits SN1 to SN3 of the note code SNC.

As above described, the signal "1" produced by one block detection circuit 201 in synchronism with the timing signal 30T is encoded through OR gate circuits 221 to 223, and then applied to the delay flip-flop circuit 234 to 236 driven by the clock signals $\phi$A and $\phi$B and the delayed signal is delivered out from the delay flip-flop circuits synchronously with the timing signal 31T as the bit SN4 of the note code SNC and as the block code SB1 and SB2. At the time of detecting the CL note, that is when a key (C4) of a note C of the lowest octave in the solo keyboard is depressed to close a corresponding key switch 204*n* the note detection circuit 302*g* produces a signal "1", as shown in Tables 4 and 5, so that it is necessary to make the block codes SB1 and SB2 to be "00" and the note codes SN1 to SN4 to be "1111". To this end, OR signal circuit 237 and AND gate circuit 239 are provided on the output sides of the delay flip-flop circuits 234 and 235, and the output signal of the note detection circuit 203 is applied to the AND gate circuit 237 and to the AND gate circuit 239 via inverter 238.

As above described, in the SK depressed key detection circuit 2*a*, a single key code SKC comprising block codes SB1 and SB2 and the note codes SN1 to SN4 corresponding to the key having the highest tone pitch among depressed keys of the solo keyboard 1*a* is produced in synchronism with the generation of the timing signal 31T.

Also the PK depressed key detection circuit 2*a* can be constructed in the same manner as the SK depressed key detection circuit 2*a* shown in FIG. 5.

C Key Code Conversion Circuit 7*a* and the First Highest Tone Detection Circuit 7*b*

Figure 7A:
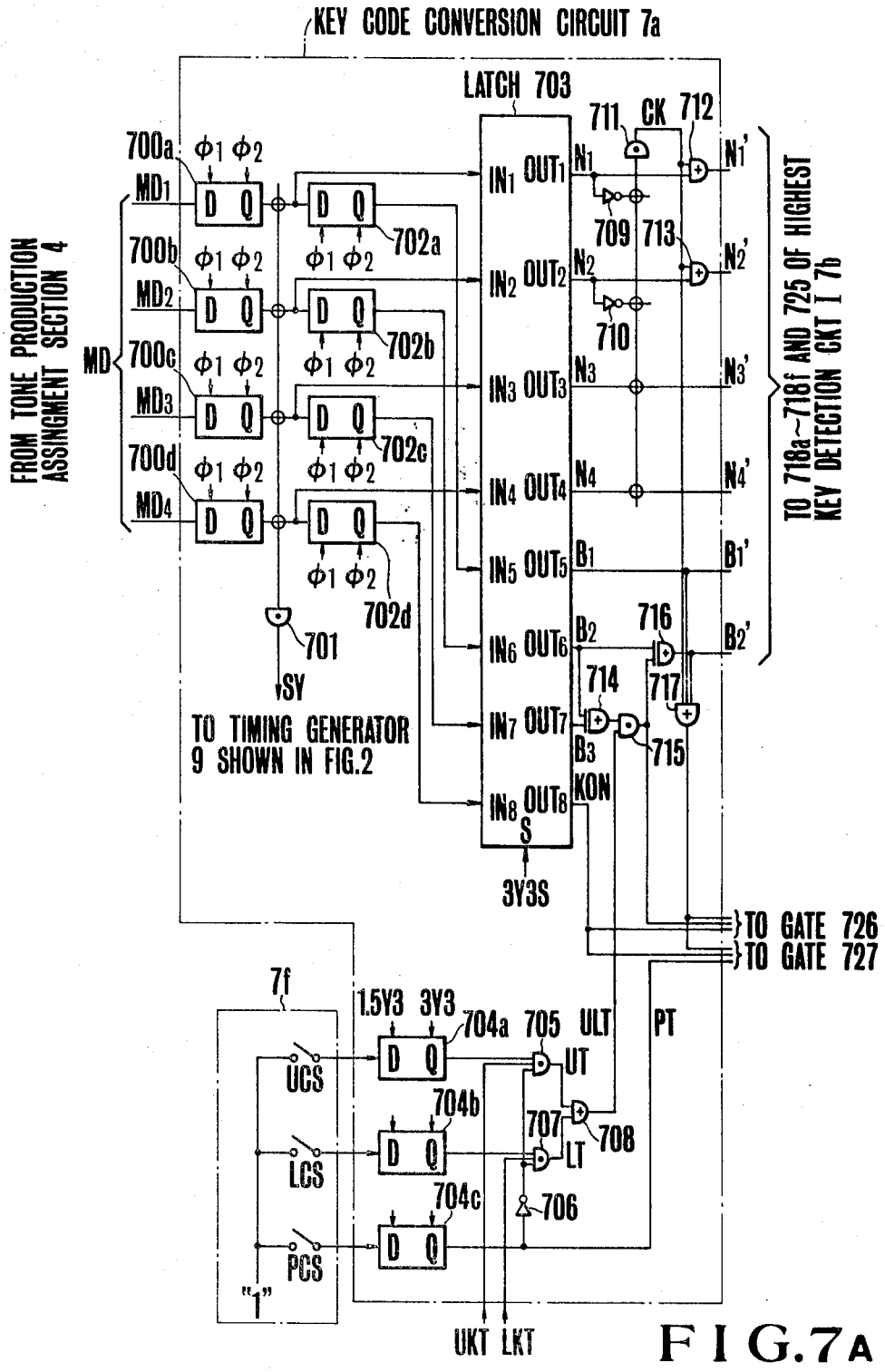
FIGS. 7A and 7B show schematic diagrams showing one examples of the key code conversion circuit and the highest key detection circuit I shown in FIG. 1.
Figure 7B:
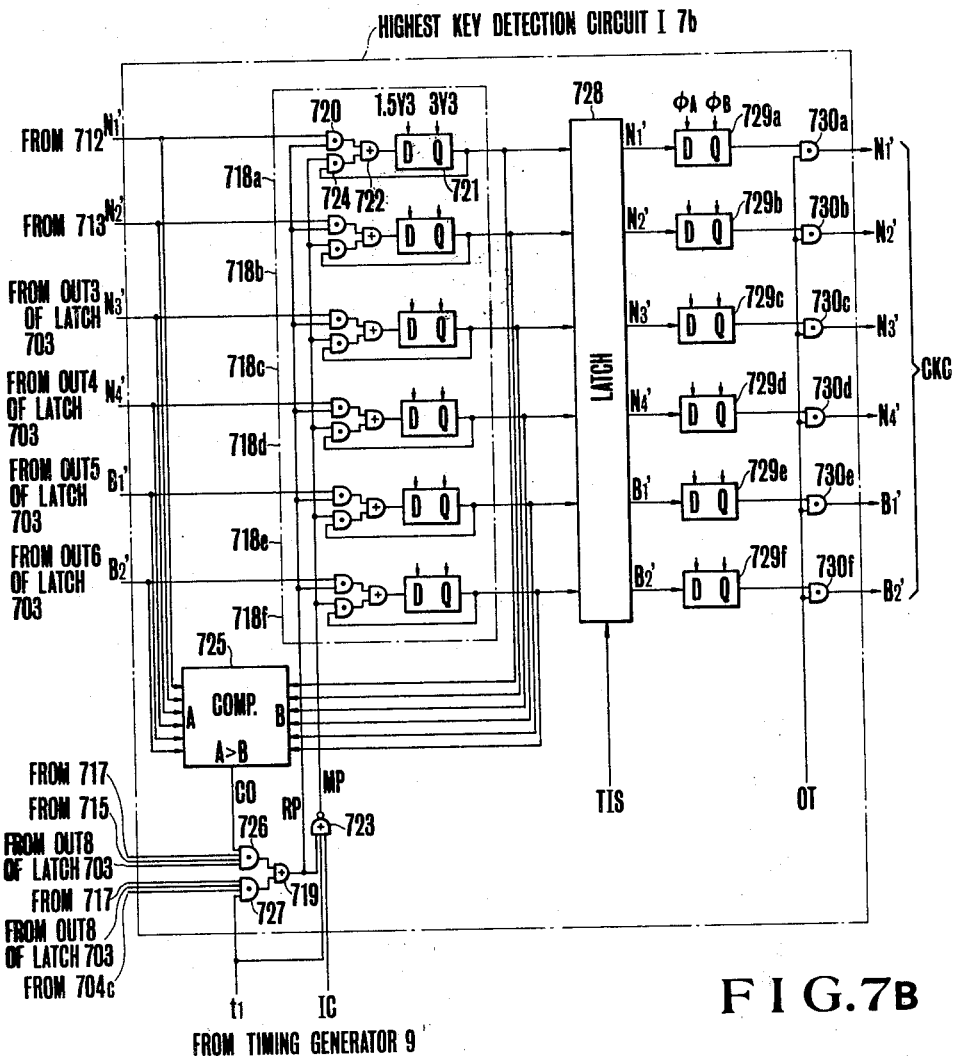

One examples of the key code conversion circuit 7*a* and the first highest tone detection circuit 7*b* shown in FIG. 1 are shown in detail in FIGS. 7A and 7B respectively. The 4 bit multiplexed data (MD1 to MD4) shown in table 7) produced by the tone production assignment unit 4 shown in FIG. 1 in synchronism with the clock signal $\phi$1 are applied to delay flip-flop circuits 700*a* to 700*d* driven by the clock signal $\phi$1 and $\phi$2 shown in FIG. 3*a* and then produced after being delayed by one bit time. The bit signals MD1 to MD4 of the delayed multiplexed data MD produced by respective delay flip-flop circuits 700*a* to 700*d* are applied to AND gate circuit 701 to detect the synchronizing data "1111", and the output "1" of the AND gate circuit 701 is applied to the timing signal generator 9 shown in FIG. 2 to act as a synchronizing signal SY that represents the initial portion of the multiplexed signal MD produced by the data multiplexing circuit 4*b*. The bit signals MD1 to MD4 of the multiplexed data produced by respective delay flip-flop circuits 700*a* to 700*d* are applied to the input terminals IN1 to IN4 of a latch circuit 703 and to the delay flip-flop circuits 702*a* to 702*d* driven by the clock signals $\phi$1 and $\phi$2. Delay flip-flop circuits 702*a* to 702*d* delay one bit time the inputted bit signals MD1 to MD4 applied to the input terminals IN5 to IN8 of the latch circuit 703.

To the strobe terminals of the latch circuit 703 is applied a timing signal 3Y3S (FIG. 3*g*) so that it latches signals inputted to respective input terminals IN1 to IN8 when the timing signal 3Y3 is generated.

As has been described in detail with reference to the timing signal generator 9 (FIG. 2) the timing signal 3Y3S is obtained by differentiating building up portion of the timing signal 3Y3S (FIG. 3*e*) that represents the third state of each multiplex channel time shown in Table 7. Accordingly, at the time of generating the timing signal 3Y3S, the delay flip-flop circuits 700*a* and 700*b* produce the bit signals MD1 to MD4 at the third state of respective multiplex channel times shown in Table 7, that is the note codes N1 to N4, whereas the delay flip-flop circuits 702*a* to 702*d* produce the bit signals MD1 to MD4 at the second state of the multiplex channel time which are obtained by delaying one bit time the output of the delay flip-flop circuits 700*a* to 700*d*, that is the block codes B1 to B3 and the key ON signal KON. For this reason, when the latch circuit 703 is latched by the timing signal 3Y3S, its output terminals OUT1 to OUT8 deliver the note code N1 to N4, the block codes B1 to B3 and the key-on signal KON. Thus, the note code N1 to N4, block code B1 to B3 and the key-on signal KON of each tone production channel are derived out sequentially in parallel from the latch circuit 703 each time the timing signal is generated.

Thus, the delay flip-flop circuit 700*a* to 700*d*, 702*a* to 702*d*, the AND gate circuit 701 and the latch circuit 703 constitute a demodulation circuit that demodulates the synchronizing data, and the note code N1 to N4, block code B1 to B3 and the key-on signal KON of each tone producing channel which are sent in time divisioned and multiplexed state as the multiplexed data.

The output signals of the UK selection switch UCS, LK selection switch LCS, and the PK selection switch PCS of the coupler keyboard selection switch unit 7*f* are respectively applied to the delay flip-flop circuits 704*a* to 704*c* by the timing action of the timing signal, 1.5Y3 and then derived out by the timing signal 3Y3 (FIG. 3*e*). This operation is performed for the purpose of preventing chattering generated by respective selection switches UCS, LCS and PCS from affecting succeeding circuits. The output signal of the flip-flop circuit 704*a* is applied to the input of AND gate circuit 705 together with the timing signal UKT (FIG. 4*e*) produced by the timing signal generator 9 shown in FIG. 2 and the output of inverter 706 which inverts the output of the delay flip-flop circuit 704*c*. The AND gate circuit 705 produces a UK selection signal UT which becomes "1" only in an interval in which a timing signal UKT is generated, which represents an interval (the second to 8th channel times shown in Table 7) during which the data (key code UKC and the key-on signal KON) of the tone producing channel for the upper keyboard are sent out in the form of multiplexed signals. The output signal of the delay flip-flop circuit 704*b* is applied to an AND gate circuit 707 together with the timing signal LKT (FIG. 4*f*) and the output of the inverter 706. The AND gate circuit 707 produces an LK selection signal LT which becomes "1" only during an interval in which the timing signal LKT is generated, the timing signal LKT representing an interval (the 9th to 15th multiplex channel times) in which the multiplexed data (key code LKC and the key-on signal KON) of the tone producing channel for the lower keyboard are produced when the LK selection switch LCS is closed. The UK selection signal UT and the LK selection signal respectively produced by the AND gate circuits 705 and 707 are produced through OR gate circuit 708 to act as the ULK selection signal ULT. Further, the output signal of the delay flip-flop circuit 704*c* is produced as the PK selection signal PT when the PK selection switch PCS is closed. At this time, the output of the inverter 706 which inverts the PK selection signal PT becomes "0" so that the AND gate circuit 705 and 707 are disabled whereby the ULK selection signal ULT would not be produced thus giving a priority to the PK selection signal PT. Because in this embodiment, a priority is given to the pedal keyboard rather than the upper and lower keyboards to act as an intermanual coupler.

On the output side of the latch circuit 703 are provided inverters 709 and 710 which invert bits N1 and N2 of the note code, and the AND gate circuit is connected to receive the outputs $\overline{N1}$ and $\overline{N2}$ of inverters 709 and 710, and the bits N3 and N4 of the note code produced by the latch circuit 703 so that the note code N4 to N1 ("1100") of the note C shown in Table 3 are detected to produce a C note detection signal CK. In response to this C note detection signal CK, the outputs of the OR gate circuits 712 and 713 become "1" whereby the note codes N4 to N1 of "1100" of the C note shown in Table 3 are converted into inherent note code N4 to N1 of "1111" of the C note.

The inverters 709, 710, AND gate circuit 711, OR gate circuit 712 constitute a note code conversion circuit which converts the note codes N1 to N4 for the UK, LK and PK shown in Table 3 into the note codes SN1 to SN4 for SK shown in Table 5.

The output of an exclusive OR gate circuit 714 connected to receive bits B2 and B3 of the block code produced by the latch circuit 703 is applied to the inputs of the AND gate circuit 715 together with the ULK selection signal ULT produced by the OR gate circuit 708. The exclusive OR gate circuit 710 is supplied with bit B3 of the block code produced by the latch circuit 703 and the output of the AND gate circuit 715 to produce an output as the bit B2′ of the conversion block code. The bit B1 of the block code is used as the bit B1 of the conversion block code without any modification. When the block code B3 to B1 becomes "010" at the time of generation of the ULK selection signal ULT, the output of the exclusive OR gate circuit 714 becomes "1" and at the same time the output of the AND gate circuit 715 also becomes "1". As a consequence, the output of the exclusive OR gate circuit 716 becomes "0" and the conversion block codes SB2′ and SB1′ becomes "00".

When the block code B3 to B1 become "100", for example, the output of the exclusive OR gate circuit 714 becomes "1".

Consequently, the output of the AND gate circuit 715 also becomes "1", but as the other input to the exclusive OR gate circuit 716 is "0", the bit B2′ of the conversion block code produced thereby becomes "1".

Consequently, the conversion block codes B2′ and B1′ becomes "10". The manner of conversion of the block codes B1 to B3 at the time of generating the ULK selection signal ULT is shown in the following Table 8.

TABLE 8

| | when ULK selection signal ULT is "1" | | | | | |
|---|---|---|---|---|---|---|
| | B3 | B2 | B1 | octave range | B2′ | B1′ |
| A | 0 | 0 | 0 | C2 | 0 | 0 |
| | 0 | 0 | 1 | C#2 to C3 | 0 | 1 |
| | 0 | 1 | 0 | C#3 to C4 | 0 | 0 |
| B | 0 | 1 | 1 | C#4 to C5 | 0 | 1 |
| | 0 | 1 | 1 | C#5 to C6 | 1 | 0 |
| | 1 | 0 | 1 | C#6 to C7 | 1 | 1 |

As above described where the block codes B1 to B3 are used for the upper or lower keyboard, they are converted into the block codes B1′ and B2′ as shown in Table 8. When the block codes B1 to B3 have the contents (showing the tone range C#4 to C7) shown in Column B of the Table 8, these codes are converted into modified block codes B1′ and B2′ having the same contents as the block codes SB1 to SB2 shown in Table 4 for the solo keyboard.

In the block conversion circuit *7a*, since the output of the AND gate circuit 715 is always "0" when the ULK selection signal ULT is generated due to the generation of the PK selection signal PT so that the lower two bits B1 and B2 of the block codes B1 to B3 become the conversion block codes B1′ and B2′ without any modification. The manner of changing the block codes B1 to B3 at the time of generation of the PK selection signal PT is shown in the following Table 9.

TABLE 9

| when PK selection signal PT is "1" | | | | |
|---|---|---|---|---|
| B3 | B2 | B1 | B2′ | B1′ |
| 0 | 0 | 0 | 0 | 0 |
| 0 | 0 | 1 | 0 | 1 |
| 0 | 1 | 0 | 1 | 0 |
| 0 | 1 | 1 | 1 | 1 |

In this manner, where the block codes B1 to B3 are used for the pedal keyboard they are converted into block order B1′ and B2′ shown in Table 9.

When the conversion block codes B1′ and B2′ are made to correspond to the block codes SB1 and SB2 for the solo keyboard shown in Table 4, the octave range of the solo keyboard would be raised by two octaves. In other words, the content (representing the octave range) of the block codes B1 to B3 for the pedal keyboard is raised by 2 octaves to change them into converted block codes B1′ and B2′ matched with the block codes SB1.

The exclusive OR gate circuits 714 and 716 and the AND gate circuit 715 constitute a block code conversion circuit that converts the block codes B1 to B3 to block codes B1′ and B2′ corresponding to the block codes SB1 and SB2 for the solo keyboard.

Above description concerns the operation of the key code conversion circuit *7a* that converts the key code KC for the upper, lower or pedal keyboard sent from the tone production assignment section 4 in the form of multiplexed data MD, that is the block codes B1 to B3 and the note codes N1 to N4 into the key code KC′ of block codes B1′ and B2′ and the note code N1′ to N4′ matched with the block codes SB1 and SB2 and the note codes SN1 to SN4 for the solo keyboard.

The first highest tone detection circuit *7b* shown in FIG. 7B will now be described. The first highest tone detection circuit *7b* comprises registers 718*a* to 718*f* which are supplied with and store the converted note codes N1′ to N4′ and the converted block codes SB1 and SB2 sent from the key code conversion circuit *7a*. Each one of the registers 718*a* to 718*f* is constituted by an AND gate circuit 720 which is supplied with an input signal (either one of the note codes N1′ to N4′ and block codes B1′ to B2′) in accordance with a write signal RP produced by an OR gate circuit 719 to be described later, an OR gate circuit 722 which applies the output of the AND gate circuit 720 to a delay flip-flop circuit 721, and an AND gate circuit 724 which is connected to receive the output of the delay flip-flop circuit 721 by a memory signal MP produced by a NOR gate circuit 723 to be described later and then feedback the output of the delay flip-flop circuit 721 to the input thereof. The delay flip-flop circuit 721 is constructed to accept an input signal in accordance with the timing signal 1.5Y3 (FIG. 3*h*) and to produce an output signal in accordance with the timing signal 3Y3 (FIG. 3*e*). Consequently, the registers 718*a* to 718*f* produce outputs in synchronism with the third state (Table 7) of respective multiplexing channel times. The first highest key detection circuit *7b* comprises a comparator 725 which is supplied with an A input consisting of the converted key codes KC′ (N1′ to N4′, B1′ and B2′) applied to respective registers 718*a* to 718*f* and a B input consisting of the outputs of respective registers 718*a* to 718*f*. The comparator 725 produces an output CO only when input A is larger than input B. The inputs of the AND gate circuit 726 are supplied with the output of an OR gate circuit supplied with the C note detection signal CK produced by the AND gate circuit 711 and the converted block codes B1′ and B2′, the output of the AND gate circuit 715 and the key-on signal KON so as to produce the write signal RP via OR gate circuit 719 at the time of generation of the ULK selection signal ULT. The AND gate circuit 727 is supplied with the output of the OR gate circuit 717, key-on signal KON, PK selection signal PT and the timing signal t1 to produce the write signal RT via the OR gate circuit 719 at the time of generation of the PK selection signal PT. The NOR gate circuit 723 is connected to receive the output (write signal RP) of the OR gate circuit 719, timing signal t1 and the initial clear signal IC and produces the memory signal MP when all of these signals RP, t1 and IC are "0".

With the first highest key detection circuit 7*b*, the contents of respective registers 718*a* to 718*f* are cleared by the initial clear signal IC which is produced when the source circuit is connected. The memory signal MP produced by the NOR gate circuit 723 becomes "0" each time the timing signal t1 (FIG. 3*d*) generated during the first multiplex channel time is supplied so as to disable the AND gate circuit 724 of respective registers 718*f* thus preventing the outputs of respective delay flip-flop circuit from feeding back to clear all contents stored.

The operation of generation the ULK selection signal ULT will now be described. During the generation of the ULK selection signal the converted key code KC' (block code B1' and B2' and the converted note code N1' to N4') are obtained by converting the key code (block code B1 to B3 and note code N1 to N4) of the upper or lower keyboard. Since key code KC (B1 to B3 and N1 to N4) represent a note range C2 to C7, the converted key code contains corresponding note range C2 to C7. However, with such correspondence, a note range C2 to B3 other than the note range C4 to C7 of the solo keyboard is also included so that a problem occurs when it is compared with the key code for the solo keyboard as will be described later. For this reason, it is essential to limit the converted key code KC' (B1', C2' and N1' to N4') to a note range C4 to C7. To this end, the outputs of the OR gate circuit 717 and AND gate circuit 715 are utilized. The output of the OR gate circuit 717 becomes "1" when either one of the bit B1' or B2' of the conversion block or the C note detection signal CK becomes "1". As can be noted from Tables 8 and 3, this occurs in a note ranges C# to C3 (B1' becomes "1"), C#4 to C5 (B1' becomes "1"), C# to C6 (B2' becomes "1"), C2 and C4 (CK becomes "1"). The output of the AND gate circuit 15 becomes "1" when the bits B2 and B3 of the block code applied to the input of the exclusive OR gate circuit 714 becomes "01" or "10" which correspond to note ranges C#3 to C4, C#4 to C5, C#5 to C6 and C#6 to C#7. The tone ranges of the cases in which the outputs of the OR gate circuit 717 and the AND gate circuit 715 become "1" respectively are summarized in the following Table 10.

TABLE 10

| the output of OR gate 717 becomes "1" | the output of AND gate 715 becomes "1" |
|---|---|
| C2<br>C#2 to C3<br>$\overline{\text{C4}}$ | C#3 to $\overline{\text{C4}}$ |
| $\overline{\text{C\#4 to C5}}$ | $\overline{\text{C\#4 to C5}}$ |
| $\overline{\text{C\#5 to C6}}$ | $\overline{\text{C\#5 to C6}}$ |
| $\overline{\text{C\#6 to C7}}$ | $\overline{\text{C\#6 to C7}}$ |

Thus, the both outputs of the OR gate circuit 717 and the AND gate circuit 715 become "1" only in the note range C4 to C7 (surrounding ranges in Table 10). Accordingly, it is possible to detect converted key codes KC' (B1', B2', N1' to N4') that match with the tone range of the solo keyboard.

Generation of the Write Signal RP at the Time of Generating the ULK Selection Signal ULT The write signal is generated by the AND gate circuit 726 which is applied with the output CO of comparator 725, the outputs of OR gate circuit 717 and AND gate circuit 715 and the key-on signal KON. Accordingly, the AND gate circuit 726 generates a write signal RP to clear registers 718*a* to 718*g* (to make the memory signal MP to "0") and then write the new high tone converted key code KC' when the following conditions are satisfied.

1. the converted key codes KC' (B1', B2', N1' to N4') produced by the key code conversion circuit 7*a* is in a note range of C4 to C2.
2. a key corresponding to the key code KC converted into said converted key code KC' is still being depressed.
3. the converted key code KC' has a higher tone pitch than the key code stored in registers 718*a* to 718*f* (CO="1"). If the write signal were not generated (that is when above described conditions 1 to 3 did not hold), the memory signal would be maintained at "1" state to hold the memory of the registers 718*a* to 718*f*.

These operations are executed in each one of the second to 18th multiplexing channel times, and when the above operations are completed at the 15th multiplexing channel time, the registers 718*a* to 718*f* are storing the highest pitch converted key codes KC' (B1', B2', N1' to N4') regarding the upper or lower keyboard and corresponding to the note range (C4 to C7) of the solo keyboard. This memory is held until the timing signal t1 (FIG. 4*d*) is generated in synchronism with the next first multichannel time and then cleared when this timing signal t1 is generated.

The converted key codes KC' having the maximum value and stored in the registers 718*a* to 718*f* are latched by the latch circuit 728 by the timing signal TIS (FIG. 4C) generated in synchronism with the building up of the first multiplexing channel time.

The converted key codes KC' (back codes B1', B2' and note codes N1' to N4') latched by the latch circuit 728 are respectively inputted into delay flip-flop circuits 729*a* to 729*f* driven by clock signals $\phi$A and $\phi$B (FIGS. 4*a* and 4*b*) to be delayed by one period of the first to 18th channel times and then taken out of the delay flip-flop circuits.

The outputs of the delay flip-flop circuits 729*a* to 729*f* are derived out as a coupler key code CKC via AND gate circuits 730*a* to 730*f* which are enabled by AND gate circuits 730*a* to 730*f* and then applied to the second highest tone pitch detection circuit 7*c*.

Generation of Write Signal RP at the Time of Generating PK Selection Signal

When a PK selection signal PT is generated by the closure of the PK selection switch PCS, AND gate circuit 727 is enabled to produce the write signal RP. In addition to the PK selection signal, the output of OR gate circuit 717, key on signal KON and timing signal t1 are also applied to the inputs of the AND gate circuit 727.

As above described, the timing signal t1 (FIG. 4*d*) is generated in synchronism with the first multiplexing channel time, and the timing of generation of this timing signal t1 lies in a channel of the pedal keyboard as shown in Table 7. Accordingly, the latch circuit 703 latches the key code KC (PKC) regarding the pedal keyboard and the key-on signal KON. As a result, the converted key code KC' (B1', B2', N1' to N4') produced by the key code conversion circuit 7a at the time of generation of the timing signal t1 is obtained by converting the key codes KC (B1 to B3, N1 to N4) of the pedal keyboard. The contents of the block codes B1' and B2' of the converted key codes KC' are shown in Table 9 with the result that the OR gate circuit 717 produces an output "1" for all contents of the converted key codes KC'.

Accordingly, when the converted key code KC' regarding the pedal keyboard is produced by the key code conversion circuit 7a, that is when the timing signal t1 is generated in the first multiplex channel time, the AND gate circuit 727 produces the write signal RP ("1") provided that the key-on signal KON is "1". Consequently, the converted key codes KC' (B1', B2' N1' N4') regarding the pedal keyboard are written into the registers 718a to 718f.

Thus, in so far as the pedal keyboard is related to only one the tone producing channels, the first highest tone detection circuit 7b would not perform the operation of the highest tone detection as in the case in which the ULK selection signal ULT is produced as above described so that the detection circuit 7b writes into the registers 718a to 718f the converted key codes KC' of the pedal keyboard as they are produced.

The converted key codes KC' written into the registers 718a to 718f are taken out as the coupler key code CKC via latch circuit 728, delay flip-flop circuits 729a to 730f in the same manner as above described.

As above described, when the ULK selection signal ULT is generated i.e. when UK selection switch UCK or LK selection switch LCS is selected the first highest key detection circuit 7b produces the converted key code KC' relating to the upper or lower keyboard and corresponding to the note range (C4 to C7) of the solo keyboard and having the highest pitch as the coupler keyboard, whereas at the time of generation of the PK selection signal PT (PK selection switch PCS is closed) the converted key codes KC' of the pedal keyboard are outputted as the coupler key code without any modification. At this time the content of the coupler key code (converted key code KC') is the same as that of the key code SKC of the solo keyboard as has been pointed out hereinbefore.

D The Second Highest Key Detection Circuit 7c

Figure 8:
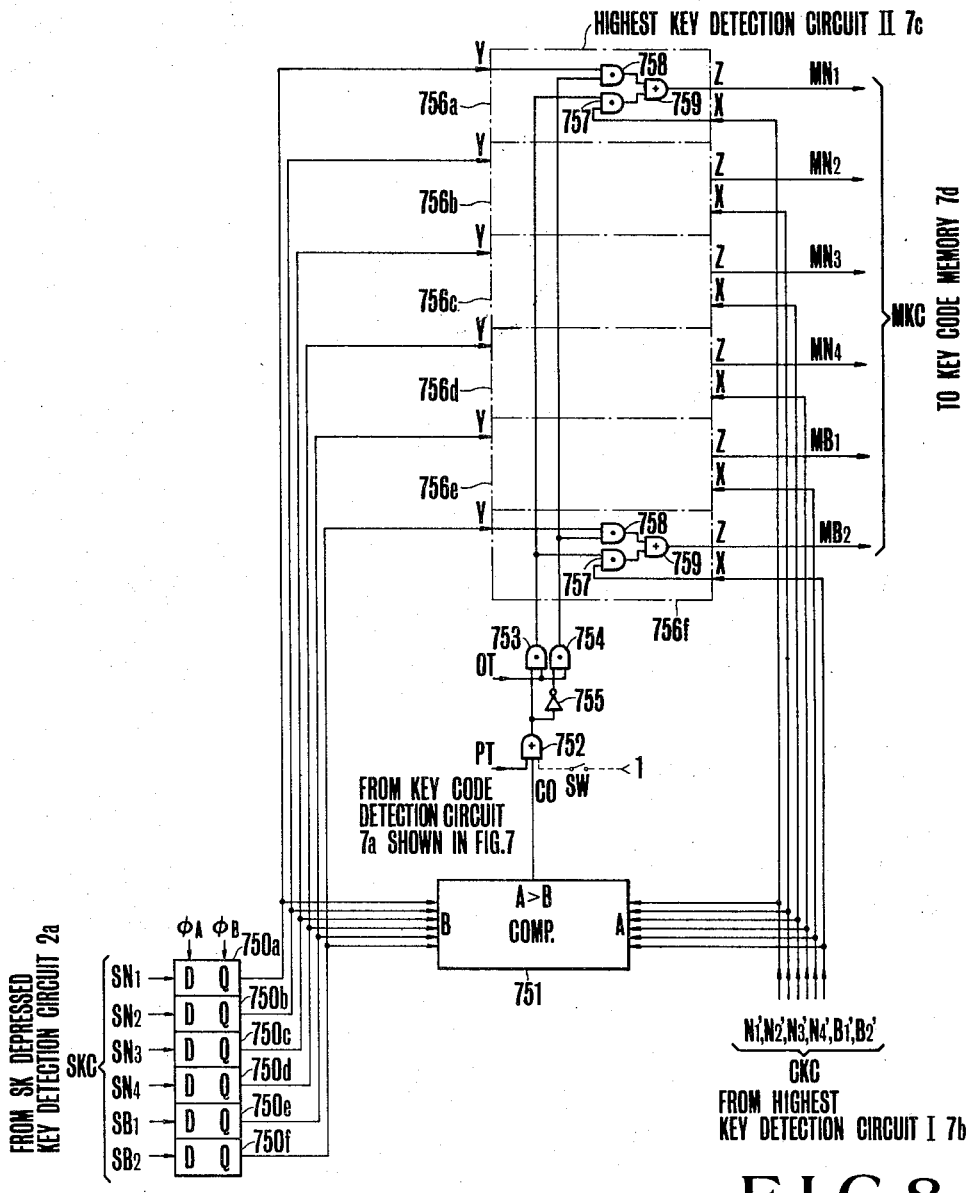
FIG. 8 is a connection diagram showing one example of the highest key detection circuit II shown in FIG. 1.

FIG. 8 shows one example of the second highest key detection circuit 7c shown in FIG. 1 which comprises delay flip-flop circuits 750a to 750f which accept the key code SKC (back codes SB1, SB2 and note codes SN1 to SN4) of the solo keyboard and produced by the SK depressed key detection circuit 2a (FIG. 5) by the timing action of the clock signal $\phi$A (FIG. 4a) and output these codes by the timing action of the clock signal $\phi$B (FIG. 4b) thereby matching their output with the coupler key code CKC produced in synchronism with the coupler key code CKC outputted from the first highest key detection circuit 7b shown in FIG. 7B in synchronism with the timing signal OT. A comparator 751 is provided to compare the coupler key code CKC supplied to its A input from the first highest key detection circuit 7b shown in FIG. 7B with the key code SKC of the solo keyboard supplied to the B input from the delay flip-flop circuits 750a to 750f. The comparator 751 produces an output CO ("1") only when A input is larger than B input. An AND gate circuit 753 is supplied with the timing signal OT and the output CO of the comparator via an OR gate circuit 752 whereas an AND gate circuit 754 is supplied with the timing signal OT and the output of an inverter 755 which inverts the output CO of the comparator via OR gate circuit 752. Accordingly, the AND gate circuit 753 produces a "1" signal in synchronism with the timing signal OT only when the coupler key code CKC is larger than the key code SKC (higher tone pitch), whereas when the coupler key code CKC is equal to or smaller than (tone pitch is equal or lower) the key code SKC, the AND gate circuit 754 produces a timing signal OT synchronous with the timing signal OT. The coupler key codes CKC (block codes B1', B2', note codes N1' to N4'), and the key code (block codes SB1, SB2, note codes SN1, SN2) applied to the A and B inputs respectively of the comparator 751 are applied to X and Y inputs respectively of the input selection circuit 756a to 756f which are provided for each bit. Accordingly, each of the input selection circuits 756a to 756f (circuits 756a and 756f alone are described in detail) is constituted by an AND gate circuit 757 applied with the output "1" of AND gate circuit 753 and a signal applied to X input, an AND gate circuit 758 with its inputs supplied with the output "1" of AND gate circuit 754 and a signal applied to Y input, and a OR gate circuit 759 for producing the outputs of AND gate circuits to output Z. Accordingly, when the output of the AND gate circuit 753 is "1", that is when the coupler key code CKC is larger than the key code of the solo keyboard, respective input selection circuit 756a to 756f send out to Z output the coupler key code CKC supplied to X input via AND gate circuit 757 and the OR gate circuit 759. On the other hand, when the output of the AND gate circuit 754 is "1", in other words, when the key code SKC is larger than the key code CKC, the key code SKC of the solo keyboard supplied to the Y input is sent to Z terminal via AND gate circuit 758 and OR gate circuit 759.

Accordingly, the input selection circuits 756a to 756f produce a key code (CKC or SKC) having higher pitch among the coupler key code CKC and the key code SKC for the solo keyboard as a key code MKC (block codes MB1, MB2, note codes MN1 to MN4) at the time of producing the timing signal OT.

While the above description relates to the highest key detection operation when the ULK selection signal ULT is being produced by the key code conversion circuit 7a shown in FIG. 7, when a PK selection signal PT is generated, this signal is outputted via OR gate circuit 752, so that the AND gate circuit 753 always produces an output "1" whenever the timing signal OT is generated, whereby the input selection circuits 756a to 756f always select a coupler key code CKC comprising the converted key code KC' of the pedal keyboard and produce it as the key code MKC.

E Key Code Memory Device 7d and Key-On Detection Circuit 7c

Figure 9:
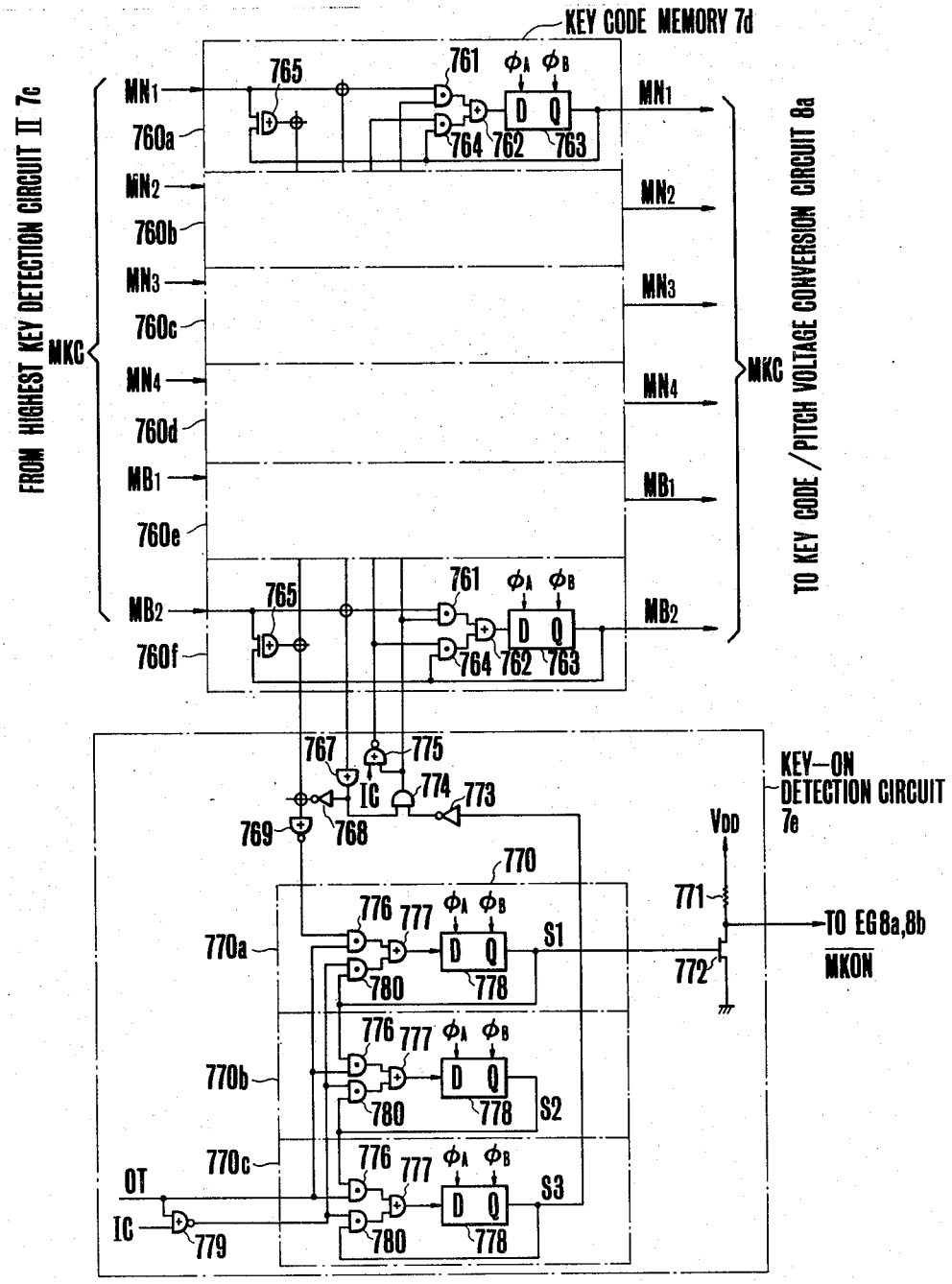
FIG. 9 is a schematic diagram showing one examples of the key code memory and the key-on detection circuit shown in FIG. 1.

FIG. 9 shows one example of the key code memory device 7e and the key-on detection circuit 7e shown in FIG. 1. The key code memory device 7d comprises memory circuits 760a to 760f respectively supplied with and store note codes MN1 to MN4 and the block codes MB1, MB2 of the key code MKC outputted by the second highest key detection circuit 7c. Each of these memory circuits 760a to 760f (only circuits 760a and 760f will be described in detail) is comprised by one stage type circulating register comprising an AND gate circuit 761 supplied with an input signal, a delay flip-flop circuit 763 which accepts the output of the AND gate circuit 761 via OR gate circuit with the clock signal $\phi$A (FIG. 4*a*) and produces an output with the clock signal $\phi$B (FIG. 4*b*), and an AND gate circuit 764 which feeds back the output of the delay flip-flop circuit 763 to the input thereof. Each one of the memory circuits 760*a* to 760*f* is provided with an exclusive OR gate circuit 765 which compares the input signal with the output signal of the delay flip-flop circuit 763 for detecting non-coincidence.

The key-on detection circuit *7e* comprises an OR gate circuit 767 supplied with the bits MN1 to MN4 and MB1, MB2 of the key code MKC inputted to the key code memory device *7d* and produces signal "1" and when the presence of the signal "1" in either one of the bits is confirmed by judging that the key code MKC is received, an NOR gate circuit 769 inputted with the output of an inverter 768 which inverts the outputs of the exclusive OR gate circuits 756 and of the OR gate circuits 767 of respective memory circuits 760*a* to 760*f*, a shift register 770 which accepts the output of the NOR gate circuit 769 each time the timing signal OT (FIG. 10*a*) is generated and successively shift the accepted output each time the timing signal OT is generated, a field effect transistor 772 connected across the source $V_{DD}$ and ground via resistor 771 and supplied with the output S1 (FIG. 10*c*) of the first stage of the shift register 770 as a gate input thereby producing an inverted key on signal $\overline{\text{MKON}}$ (FIG. 10*f*), an AND gate circuit 774 is supplied with the output S3 (FIG. 10*e*) of the third stage of the shift register 770, which is inverted by an inverter 773 and the output of the OR gate circuit 767, the output of the AND gate circuit 774 being applied to the input of an AND gate circuit 761, and a NOR gate circuit 775 which is supplied with the output signal of the AND gate circuit 774 and the initial clear signal IC and applies its output signal "1" to the AND gate circuits 764 of respective memory circuits 760*a* to 760*f* to act as the holding signal of them. The shift register 770 comprises cascade connected shift registers 770*a* to 770*c*, each constituted by an AND gate circuit 706 which is supplied with an input in accordance with the timing signal OT, a delay flip-flop circuit 778 which receives the output of the AND gate circuit 776 via OR gate circuit 777 in accordance with the clock signal $\phi$A (FIG. 4*a*) and delivers its output in accordance with clock signal $\phi$B (FIG. 4*b*), and an AND gate 780 which feeds back the output of the delay flip-flop circuit 778 to the input thereof via OR gate circuit 777 in accordance with the output "1" of NOR gate circuit 779 inputted with the timing signal OT and the initial clear signal IC.

In the key code memory device *7d* having a construction as above described, when the second highest key detection circuit *7c* (FIG. 8) of the key-on detection circuit *7e* does not produce a key code MK, the output of the OR gate circuit 767 which detects the arrival of the key code KC becomes "0" with the result that the output of the inverter 768 becomes "1". As a result, the output of the NOR gate circuit 769 becomes "0" so that the shift register 770 sequentially shifts this 0 signal each time the timing signal OT is generated, with the result that the inverter 777 that inverts the output S3 of the third stage of the shift register 770 continues to produce signal "1". Under these states, when the circuit *7c* produces key code MKC at time TA shown in FIG. 10(*a*) by the timing action of the timing signal OT, the OR gate circuit 767 of the key-on detection circuit *7c* produces signal "1" showing the arrival of the key code MKC. The exclusive OR gate circuit 765 of each one of the memory circuits 760*a* to 760*f* of the key code memory device *7d* compares the output signal supplied by the second highest key detection circuit (respective bits MN1 to MN4, MB1, MB2 of the key code MKC) with the signal produced by the delay flip-flop circuit 763 so as to detect whether the same key code MKC is supplied continuously or not over a predetermined interval.

At this time since the key code MKC has arrived for the first time, the output of either one of the exclusive OR gate circuits of the memory citcuits 760*a* to 760*f* becomes "1". As a consequence, the output of the NOR gate circuit is continuously maintained at "0" state.

Since the output of inverter 773 is "1" as above described, when the OR gate circuit 767 produces a signal "1", the AND gate signal 774 applies this signal "1" to AND gate circuits 761 of respective memory circuits 760*a* to 760*f*. The AND gate circuits 761 are also supplied with respective bits MN1 to MN4 and MB1, MB2 of the key code produced by the second highest key detection circuit *7c* for applying these bits to the delay flip-flop circuits 763 via OR gate circuits 762. Each delay flip-flop circuit accepts the input signal by the timing action of the clock signal $\phi$A and produces a delayed signal by the timing action of the clock signal $\phi$B. During an interval in which the AND gate circuit 774 produces signal "1", the NOR gate circuit 775 produces a "0" output with the result that the AND gate circuits 764 of the memory circuit 760*a* to 760*f* are disabled to prevent feeding back of the outputs of delay flip-flop circuits 763 to their inputs. Consequently, the bits MN1 to MN4, MB1 and MB2 of the input key code MKC are accepted by the delay flip-flop circuits 763 of respective memory circuits 760*a* to 760*f*. When the key code MKC produced by the second highest key detection circuit disappears after the timing signal OT, the output of the OR gate circuit 767 that detects the arrival of the key code MKC becomes "0" whereby the output signal of the AND gate circuit 774 becomes "0". Then, the holding signal produced by the NOR gate circuit 775 becomes "1". Then, the AND gate circuits 764 of the memory circuits 760*a* to 760*f* operates to feed back the outputs of respective delay flip-flop circuits 763 to the input thereof via OR gate circuits 762 with the result that the input signals (key code MKC) applied to the delay flip-flop circuits 763 via AND gate circuits 761 at the time of generation of the timing signal OT are stored or held. The key code MKC thus stored in respective memory circuits 760*a* to 760*f* is converted into a tone pitch voltage KV having a corresponding tone pitch by a key code/pitch voltage conversion circuit (to be described later) as shown in FIG. 10*b*. As will be described later, since at this time, however, the key-on detection circuit *7c* does not produce an inverted key-on signal $\overline{\text{MKON}}$ ("0") no tone is generated.

Figure 10:
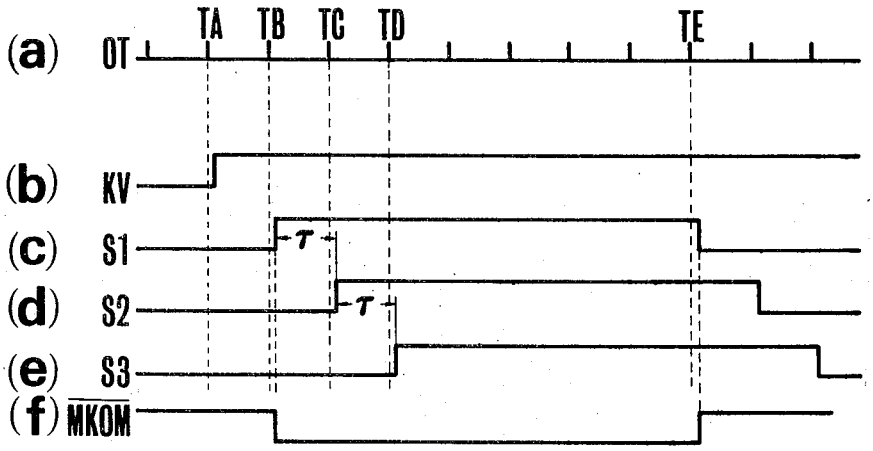
FIGS. 10 and 11 are waveforms useful to explain the operation of the key-on detection circuit shown in FIG. 9.

When the timing signal OT is generated at time TB shown in FIG. 10(*a*), the second highest key detection circuit *7c* produces again the key code MKC. Then OR gate circuit 767 produces a signal "1" showing the arrival of the key code MKC whereby the output of the inverter 768 becomes "0". The exclusive OR gate circuit 765 of each of the memory circuit 760*a* to 760*f* compares the newly supplied key code MKC with respective bits of the key code MKC which have been stored and then outputted from the delay flip-flop circuit 763. When a coincidence is obtained the exclusive OR gate circuit produces "0". When the outputs of all exclusive OR gate circuits 765 of the memory circuits 760*a* to 760*f* becomes "0" the NOR gate circuit 769 applies a signal "1" to shift register 770. Consequently, this output signal of the NOR gate circuit 769 shows that the key code MKC supplied from the second highest key detection circuit has the same content even in the next period, (i.e. at time TB shown in FIG. 10*a*) of the timing signal OT. When the output of the OR gate circuit 767 becomes "1" the output of the AND gate circuit 774 also becomes "1" to produce an accepting signal. Then, in the same manner as above described, the AND gate circuits 761 of the memory circuits 760*a* to 760*f* supply the bits MN1 to MN4, MB1 and MB2 to the delay flip-flop circuits 713. Thereafter, these flip-flop circuits hold the inputted key codes in the same manner as above described.

When the output of the NOR gate circuit 769 becomes "1", the timing signal OT causes the AND gate circuits 776 to apply this output "1" to the delay flip-flop circuits 778 via OR gate circuits 777. These delay flip-flop circuits 778 accept the output signals of the AND gate circuits 776 by the timing signal $\phi$A, thus sensing out signal S1 ("1") as shown in FIG. 10*c* by the clock signal $\phi$B. After the termination of the timing signal OT, the AND gate circuit 780 of the registers 770 are enabled by a signal "1" produced by the NOR gate circuit 779 until the next timing signal OT is generated (at time TC shown in FIG. 10*a*), and the signal "1" is circulated and stored through the delay flip-flop circuits 778, AND gate circuits 780 and OR gate circuits 777 by feeding back and outputs of the delay flip-flop circuits 778 to the inputs thereof. The register 770*b* comprising the second stage of the shift register 770 is provided for receiving and storing the output of the register 770*a* of the first stage of shift register 770 by the timing action of the next timing action OT (at time TC shown in FIG. 10*a*). Accordingly, the output of the register 770*b* is generated at a time later than the generation of the output of the first stage (FIG. 10*c*) by $\tau$ corresponding to one period of the timing signal OT, as shown in FIG. 10*d*. Since the register 770*c* comprising the third stage of the shift register 770 receives and holds the output of the second stage 770*b* by the next timing signal OT (at time TD shown in FIG. 10*d*) its output is produced at a time later than the generation of the output of the second stage (FIG. 10*e*) by $\tau$ corresponding to one period of the timing signal OT.

The output S1 of the first stage 770*a* is supplied to a field effect transistor 772 so that when it is turned ON the inverted key-on signal $\overline{\text{MKON}}$ becomes "0" which is supplied to EG 8*e* and 8*f* of the second tone production system shown in FIG. 1 to cause them to initiate generation of the envelope control waveforms EW1 and EW2 thereby producing a musical tone.

The above description concerns the operation of the key memory device 7*e* between a state in which the second highest key detection circuit 7*c* does not send out a key code MKC and another state in which the key code MKC is produced. Thereafter, the fact that content of the key code supplied at each generation of the timing signal OT has the same content over one period thereof thus confirming that the signal inputted to the key code memory device 7*d* is not a noise signal but a normal key code MKC. The confirmation signal of this key code MKC is produced as an "1" signal from the NOR gate circuit 769 and the key-on detection signal 7*c* applies the output of the NOR gate circuit 769 to the shift register 770 which shift the signal with the period of the timing signal OT. An inverted key-on signal $\overline{\text{MKON}}$ is generated corresponding to the output S1 of the first stage 770*a* of the shift register.

Thus the key-on detection circuit 7*e* produces an inverted key-on signal KON ("0") about one period later than the timing signal OT after the key code MKC has been supplied from the second highest key detection circuit OT.

Now a case will be described in which all keys of the solo keyboard and the upper or lower keyboard or the pedal keyboard are released and the second highest key detection circuit 7*c* does not produce any key code MKC by the timing action of the timing signal OT after a time TE shown in FIG. 10*a*.

Since no key code MKC is applied to the key code memory device 7*d* at time TE shown in FIG. 10*a*, the OR gate circuit 767 still continues to produce an output "0" and the inverter 768 also continues to produce an output "1". The outputs of the exclusive OR gate circuits 765 of respective memory circuits 760*a* to 760*f* are also "1". Consequently, the outputs of the AND gate circuits 774 are "0" so that the AND gate circuits 761 for applying inputs to respective memory circuits 760*a* to 760*f* would not be enabled. Since the output of the NOR gate circuit 775 is "1" the holding AND gate circuits 764 of the memory circuits 760*a* to 760*f* are in their enabled states to feed back the outputs of the delay flip-flop circuits 763 to the inputs thereof, thus maintaining their memories. For this reason even when all keys are released, the memory key codes MKC produced by the key code memory device 7*d* would not be changed and hence the pitch voltage KV produced by the key code/pitch voltage converter 8*a* would not be changed.

As above described since the outputs of the inverter 768 and the exclusive OR gate circuit 765 are "1" at time TE, the output of the NOR gate circuit 769 is "0".

Accordingly, even when the timing signal OT is generated, signal "1" would not be applied to the register 770*a* of the first stage of the shift register 770, and since the memory in the register 770*a* is cleared when the timing signal is generated (because the holding AND gate circuit 780 is disabled) the output S1 of register 770 becomes "0" immediately after time TE as shown in FIG. 10*c*. Consequently, the transistor 772 is turned OFF to cause the inverted key-on signal $\overline{\text{MKON}}$ to become "1" whereby the generation of the musical tone signal of the second musical tone signal generator 8 is transferred to a release operation.

At this time, since the key code memory device is still storing the key code MKC even after the key release, there is no fear of varying the pitch at the release portion of the musical tone generated.

When the key code MKC produced by the timing signal OT (FIG. 11*a*) from the second highest key detection circuit 7*c* at time TF changes to a key code representing another tone pitch, i.e. when the second highest key detection circuit 7*c* produces a key code MKC' having higher pitch, in the same manner as above described, the key code held in the key code memory device is compared with the new key code MKC'. At this time, since these key codes do not coincide with each other, the NOR gate circuit 769 produces a "0" signal.

Figure 11:
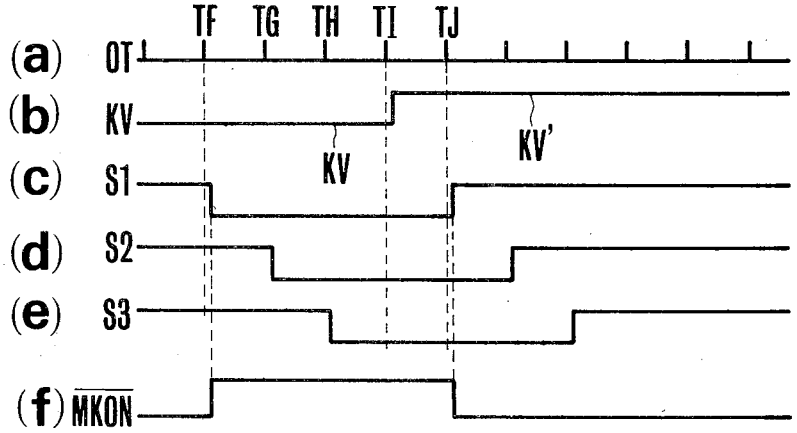

This output signal "0" of the NOR gate circuit 769 is applied to the shift register 770 so that the output signal S1 of the first stage becomes "0" immediately after time TF as shown in FIG. 11c. As a consequence, the inverted key-on signal $\overline{MKON}$ produced by the field effect transistor 772 supplied with the output 770a of the first stage S1 of the shift register 770 becomes "1" as shown in FIG. 11f whereby the second tone production system 8 produces envelope control waveforms EW1 and EW2 to generally decrease the musical tone signal generated since EG8e and 8f are in the release state. Since the output S3 of the third stage 770c of the shift register 770 is "1" as shown in FIG. 11e at time TF at which the key code MKC changes, the output of the inverter 773 becomes "0" to prevent the AND gate circuit 774 for sending out an acceptance signal so that the key code memory device 7d continues to hold previous key code MKC'. On the other hand, the output signal S1 ("0", FIG. 11c) of the first stage 770a of the shift register 770 is shifted to the register 770b of the second stage by the timing action of the next timing signal OT so that its output signal S2 becomes "0" immediately after time TG as shown in FIG. 11d. In the same manner, the output signal S2 of the second stage register 770b is shifted to the third stage register 770c at time TH by the next timing signal OT so that the output signal S3 of the third stage register 770c becomes "0" immediately after the time TH as shown in FIG. 11e. When the key code MKC produced by the second highest key detection circuit 7c is changed in this manner, the output signal S3 of the shift register 770c becomes "0" as shown in FIG. 11e at the third period of the timing signal OT. As a consequence, the output of inverter 773 becomes "1" so as to cause the AND gate circuit 774 to apply an accepting signal to the key code memory device 7d. Accordingly, the key code memory device 7d stores the new code MKC' which was varied at the fourth period (at time TI) of the timing signal after variation of the key code MKC. The key code/-tone pitch voltage conversion circuit 8a which converts this stored key code MKC' into a corresponding tone pitch voltage produces a tone pitch voltage KV' at time TI as shown in FIG. 11(b). When the key code MKC' is stored in the key code memory device 7d, the key code MKC' produced by the second highest key detection circuit 7e produced at the time (TI) of generation of the next timing signal OT is compared with the stored key code MKC'. When these key codes coincide with each other, the output of the NOR gate circuit 769 becomes "1" which is received by the shift register 770 in synchronism with the generation of the timing signal OT at time TS, so that the output S1 of its first stage becomes "1" immediately after time TJ as shown in FIG. 11c. Then the field effect transistor 772 produces an inverted key-on signal $\overline{MKON}$ and the second musical tone production system 8 produces a musical tone signal having a pitch corresponding to the output key code MKC' of the key code memory device 7d. Thus, when the key code MKC produced by the second highest key detection circuit 7c is changed, the inverted key-on signal $\overline{MKON}$ instantly becomes "0" so that the inverted key-on signal $\overline{MKON}$ again becomes "0" at and after the fifth period of the timing signal, thus generating a musical tone signal having a pitch corresponding to the varied key code MKC'. The reason that the generation of the inverted key-on signal $\overline{MKON}$ ("0") is prevented over four periods (from time TF to time TJ) of the timing signal OT when the key code MKC generated by the second higher key detection circuit 7c lies in that, when generating a musical tone signal corresponding to the varied key code MKC' from the second musical tone signal generator 8, it is necessary to reset EG 8e and 8f for the purpose of imparting an envelope starting from the first portion (attack portion), and that four periods of the timing signal OT is necessary as the reset period for EG8e and 8f.

F Key Code/Tone Pitch Voltage Converting Circuit 8a

Figure 12:
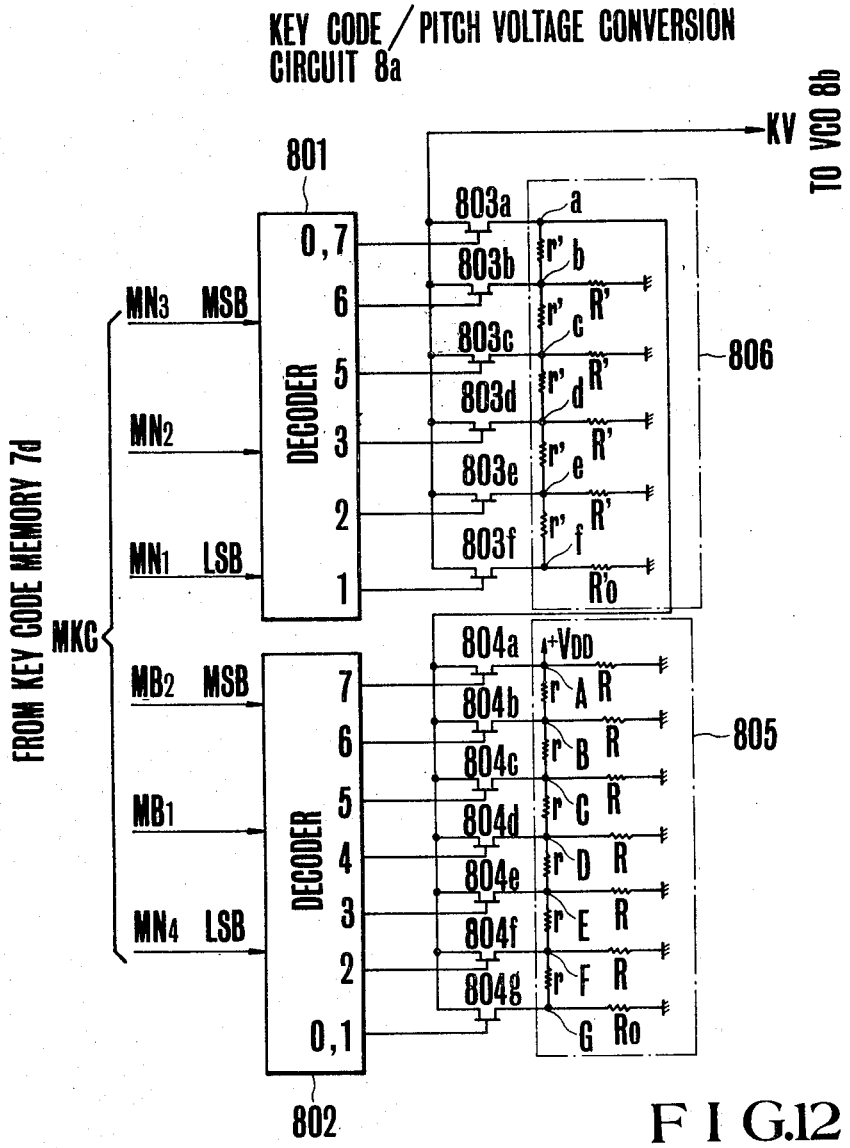
FIG. 12 is a schematic diagram showing one example of the key-code/pitch-voltage converter shown in FIG. 1.

FIG. 12 shows the detail of one example of the key code/tone pitch voltage conversion circuit 8a shown in FIG. 1 in which among the key codes MKC produced by the key code memory device 7d (FIG. 9), the note codes MN1 to MN4 are converted into decimal numbers by decoder 801 to produce signal "1" from corresponding output terminals. The decoder 801 converts both input signals "000" and "111" into a decimal number "7". Further, the bit MN4 of the note codes MN1 to MN4 and the block codes MB1 and MB2 are inputted to a decoder 802 to be converted into decimal numbers. In this case, the decoder 802 converts both input signals "000" and "001" into a decimal "1". To the output terminals of the decoders 801 and 802 are connected the gate electrodes to respective field effect transistors 803a to 803f and 804a to 804g with their source electrodes commonly connected for decoders 801 and 802, respectively. The drain electrodes of transistors 804a to 804g are connected to respective junctures A to G of a first potentiometer circuit 805 connected to divide the voltage of the source $V_{DD}$ by resistors r, R and Ro.

The drain electrodes of the field effect transistors 803a to 803f are connected to respective junctures a to f of a second potentiometer circuit 806 which is constructed to divide the output voltage of the first potentiometer circuit 805 by resistors r', R' and Ro'. The voltage at a junction (one of A to G) taken out through one transistor (one of 804a to 804g) which is turned ON by the output of the decoder 802 is divided further by the resistors r', R' and Ro' of the second potentiometer circuit 806 and the voltages at respective junctures a to f are outputted through the tone pitch voltage KV respectively through field effect transistors 803a to 803f as the tone pitch voltage KV.

The voltages at respective junctions A to G of the first potentiometer circuit 805 correspond to blocks U6b to U3b shown in FIG. 6 and respective junctions a to f of the second potentiometer circuit 806 correspond to notes (G, C#) (G#, D) (A, D#), (A#, E), (B, F), (C, F#). Consequently, when a key code MKC representing note A# (or E) of the U4b back, for example, is supplied, the input terminal of the decoder 802 is supplied with a signal "011" from the most significant bit side, whereas the input terminal of the decoder 801 is supplied with a signal "101" from the most significant bit side. Consequently, the decoder 802 produces an output "1" only from its output terminal 3, while the decoder 801 produces an output "1" only from its output terminal 5. Accordingly only the first effect transistors 803c and 804e are turned ON which are connected to terminal now producing signals "1" among field effect transistors 802a to 802f and 804a to 804g connected to the output terminals of the decoders 801 and 802. In other words, the voltage at the junction E of the first potentiometer circuit 805 is outputted through the transistor 804e. This voltage is divided further by the second voltage dividing circuit 806 and the voltage at its junction C is produced via transistor 803c as a tone pitch voltage KV corresponding to the tone pitch E5.

The decoders 801 and 802 are constructed such that they produce "1" signal at their decimal "7" and "1", output terminals even in a case where all their input signals are "0", for the purpose of performing a portamento operation from a predetermined tone pitch at the time of commencing a portamento performance.

Although in the above described embodiment when the PK selection switch PCS of the coupler keyboard selection switch *7f* is closed the key code PKC of the pedal keyboard was always supplied to the second musical signal generator 8 as the key code MKC, it will be clear that another keyboard can be substituted for the pedal keyboard. Instead of using the highest key detection circuit 7 (first and second highest key detection circuits *7b* and *7c*) a lowest key detection unit may also be used, in which case the comparator 725 (FIG. *7b*) and 751 (FIG. 8) of respective detection circuits *7b* and *7c* are constructed such that they produce outputs CO when their A inputs are smaller than their B inputs.

As above described, the electronic musical instrument of this invention is constructed such that a key information representing a depressed key of a solo keyboard is compared with a key information of a depressed key of an upper or lower keyboard or a pedal keyboard so as to select only a key information representing the highest or lowest key information and supply the selected key information to a solo musical tone signal generator so that it is possible to automatically change the intermanual coupler condition by merely changing the manner of key depression of the keyboard without operating any special switch (intercoupler selection switch), thus greatly improving the performance characteristics of the electronic musical instrument.

Furthermore, as the electronic musical instrument of this invention is constructed such that when the intercoupler selection switch selects a first keyboard (upper or lower keyboard), it selects a single key information corresponding to the highest or lowest tone among the key informations representing depressed keys of the first keyboard and a third keyboard (solo keyboard) and supplies the selected key information to a musical tone signal generator (for a solo tone), whereas when the intercoupler selection switch selects a second keyboard pedal keyboard, it preferentially selects a key information representing a key information representing a depressed key representing the second keyboard and supplies the selected key information to the musical tone signal generator so that it is possible to change the condition of the intercoupler by merely changing the manner of depressing the keys of the first and third keyboards. This construction also makes it possible to cause the musical tone signal generator to continuously generate a musical tone of the depressed key of the second keyboard independently of the first and third keyboards. This also greatly improve the performance characteristics of the electronic musical instrument.

Although in the foregoing embodiment, a priority order was established among all keyboards such priority may be established between specific two key keyboards.

Furthermore, instead of supplying the highest key tone signal to the tone signal production system of the solo keyboard, the highest key tone signal may be supplied to a tone signal production system of any other keyboard, or to an additional tone signal production system.

The embodiment described above may be modified such that a signal "1" of a bias source is applied to one input of the OR gate circuit 752 shown in FIG. 8 via a suitable switch which is normally opened but closed when the solo performance system is disconnected.

It should be understood that the invention is not limited to the specific embodiment described above and that various changes and modifications will be obvious to one skilled in the art without departing from the true spirit and scope of the invention as defined in the appended claims.

What is claimed is:

1. An electronic musical instrument comprising:

a plurality of separate keyboards, each said keyboard provided with a plurality of keys;

key detectors provided for each of said respective keyboards for generating a key identifying signal, each key identifying signal corresponding to and identifying each depressed key of each said respective keyboard;

keyboard-dependent tone production systems provided for respective key detectors for separately producing musical tone signals for respective separate keyboards in accordance with the respective key identifying signals; and priority selection means for selecting a single key identifying signal from among the key identifying signals produced by said key detectors in accordance with a predetermined common order of priority that is established throughout the plurality of keyboards.

2. An electronic musical instrument according to claim 1 further including a musical signal generating system for producing a musical tone signal in accordance with the selected single key identifying signal, said musical tone signal generating system provided separately from said keyboard-dependent tone production systems.

3. An electronic musical instrument according to claim 2 wherein said priority selection means includes a key-on detection circuit which produces a key-on signal, said key-on signal produced independently of the depression of a key after said key identifying signal produced by said priority selection means has remained unchanged for a predetermined period of time, said key-on detection circuit temporarily interrupting said key-on signal when there is a change in said key identifying signal, and wherein said musical tone signal generating system includes means for producing a musical tone signal with a newly commenced envelope based on said key-on signal.

4. An electronic musical instrument comprising:

a plurality of separate keyboards, each provided with a plurality of keys;

key detectors provided for the respective keyboards for generating a key identifying signal, each said key identifying signal corresponding to and identifying each depressed key of each said respective keyboard;

keyboard-dependent tone production systems provided for respective key detectors for separately producing musical tone signals for respective separate keyboards in accordance with respective key identifying signals, a key identifying signal corresponding to each said depressed key being supplied to said keyboard-dependent tone production system; and priority selection means for selecting a single key identifying signal from among the key identifying signals produced by said key detectors in accordance with a predetermined common order of priority that is established throughout the plurality of keyboards;

one of said keyboard-dependent tone production systems being supplied with said selected single key identifying signal and producing a musical tone signal in accordance therewith.

5. An electronic musical instrument according to claim 4 wherein the key detector corresponding to said selected keyboard-dependent tone production system includes single key preferential selection means which selects a single key according to a first predetermined order of priority and comprises a first detector producing a first key identifying signal that represents the selected single key of the depressed keys in the corresponding keyboard, and wherein said priority selection means comprises a first selection circuit which selects a second key identifying signal from the depressed key detectors other than said first detector according to a second predetermined order of priority, and a second selection circuit for selecting either of the second key identifying signal and the first key identifying signal according to a third predetermined order of priority, the second selection circuit producing an output as the output of said priority selection means.

6. An electronic musical instrument according to claim 4 wherein said priority selection means includes a key-on detection circuit which produces a key-on signal, said key-on signal produced independently of the depression of a key and after said key identifying signal produced by said priority selection means has remained unchanged for a predetermined period of time, said key-on detection circuit temporarily interrupting said key-on signal when there is a change in said key identifying signal, and wherein one of said keyboard-dependent tone production systems includes means for producing a musical tone signal with a newly commenced envelope based on said key-on signal.

7. An electronic musical instrument according to claim 3 or 4 wherein said priority selection means comprises control means for determining which of said key identifying signals produced by respective depressed key detectors are included among said key identifying signals from which said single key identifying signal is selected.

8. An electronic musical instrument according to claim 7 wherein said control means is one in which the mentioned determination is executed in accordance with an order of priority predetermined with relation to said keyboards.

* * * * *